US011045850B2

(12) United States Patent
Smith et al.

(10) Patent No.: US 11,045,850 B2
(45) Date of Patent: Jun. 29, 2021

(54) APPARATUS AND METHODS TO INCREASE THE EFFICIENCY OF ROLL-FORMING AND LEVELING SYSTEMS

(71) Applicant: The Bradbury Company, Inc., Moundridge, KS (US)

(72) Inventors: Gregory S. Smith, McPherson, KS (US); Zachary Williams, Wichita, KS (US); Roger Downing, Hutchinson, KS (US)

(73) Assignee: The Bradbury Company, Inc., Moundridge, KS (US)

( * ) Notice: Subject to any disclaimer, the term of this patent is extended or adjusted under 35 U.S.C. 154(b) by 147 days.

(21) Appl. No.: 16/297,063

(22) Filed: Mar. 8, 2019

(65) Prior Publication Data

US 2019/0201955 A1 Jul. 4, 2019

Related U.S. Application Data

(63) Continuation of application No. 14/718,960, filed on May 21, 2015, now Pat. No. 10,252,306, which is a (Continued)

(51) Int. Cl.
*B21B 37/46* (2006.01)
*B21D 1/02* (2006.01)

(52) U.S. Cl.
CPC ..... *B21B 37/46* (2013.01); *B21D 1/02* (2013.01)

(58) Field of Classification Search
CPC ..... B21B 2275/02; B21B 2275/04; B21B 2275/10; B21B 1/22; B21B 1/24; B21B 37/46; B21B 37/52; B21D 1/02
See application file for complete search history.

(56) References Cited

U.S. PATENT DOCUMENTS 1,946,240 A 2/1934 Rohn
3,355,918 A 12/1967 Wallace
(Continued)

FOREIGN PATENT DOCUMENTS

CA 2814077 4/2012
CA 2643296 8/2016
(Continued)

OTHER PUBLICATIONS

IP Australia, "Office Action," issued in connection with Australian Patent Application No. 2011311892, dated Mar. 16, 2015, 6 pages.
(Continued)

*Primary Examiner* — Matthew Katcoff
(74) *Attorney, Agent, or Firm* — Hanley, Flight & Zimmerman, LLC

(57) ABSTRACT

Methods and Apparatus to increase the efficiency of roll-forming and leveling systems are described herein. An example strip material processing apparatus includes a first drive system to drive an exit workroll at an exit of the strip material processing apparatus, and a second drive system to drive an entry workroll at an entry of the strip material processing apparatus, where the strip material is to travel through the strip material processing apparatus from the entry to the exit. The example strip material processing apparatus also includes a controller to provide a first command reference to the first drive system to drive the exit workroll at the first command reference. The controller is to determine a first torque value of the first drive system when the first drive system operates at the first command reference, and the controller is to determine a second torque value based on a ratio of the first torque value to the second torque value such that the first torque value and the second torque value are different. The controller is to also drive the
(Continued)

entry workroll via the second drive system to maintain the ratio.

16 Claims, 14 Drawing Sheets

Related U.S. Application Data continuation of application No. 13/267,760, filed on Oct. 6, 2011, now Pat. No. 9,050,638.

(60) Provisional application No. 61/390,467, filed on Oct. 6, 2010.

(56) References Cited

U.S. PATENT DOCUMENTS

| | | | |
|---|---|---|---|
| 3,764,050 | A | 10/1973 | Clark |
| 3,867,826 | A | 2/1975 | Noe |
| 4,126,028 | A | 11/1978 | Chapront |
| 4,244,204 | A | 1/1981 | Vydrin et al. |
| 4,287,738 | A | 9/1981 | Hojas et al. |
| 4,354,372 | A | 10/1982 | Inoue et al. |
| 4,365,496 | A | 12/1982 | Shiozaki et al. |
| 4,485,497 | A | 12/1984 | Miura |
| 4,566,299 | A | 1/1986 | Koyama et al. |
| 4,599,883 | A | 7/1986 | Ginzburg et al. |
| 4,635,458 | A | 1/1987 | Bradlee |
| 4,651,549 | A | 3/1987 | Masui |
| 4,730,472 | A | 3/1988 | Ellis |
| 4,881,392 | A | 11/1989 | Thompson et al. |
| 5,632,177 | A | 5/1997 | Narita et al. |
| 5,713,256 | A | 2/1998 | Keeny |
| 5,874,813 | A | 2/1999 | Bode et al. |
| 6,205,829 | B1 | 3/2001 | Schwedt |
| 6,769,279 | B1 | 8/2004 | Bergman et al. |
| 7,086,260 | B2 | 8/2006 | Abi-Karam |
| 7,294,991 | B2 | 11/2007 | Kimura et al. |
| 7,325,489 | B2 | 2/2008 | Zeigler et al. |
| 7,383,711 | B2 | 6/2008 | McKenna |
| 7,524,400 | B2 | 4/2009 | Franz |
| 7,812,558 | B2 | 10/2010 | Mod et al. |
| 8,893,537 | B2 | 11/2014 | Cox, III |
| 9,050,638 | B2 | 6/2015 | Smith et al. |
| 2006/0277959 | A1 | 12/2006 | McKenna |
| 2008/0223100 | A1 | 9/2008 | Verloop et al. |
| 2009/0113973 | A1 | 5/2009 | Cox, III |
| 2010/0058823 | A1 | 3/2010 | Polatidis et al. |
| 2011/0041580 | A1 | 2/2011 | Ogawa et al. |
| 2012/0047977 | A1 | 3/2012 | Smith et al. |
| 2015/0040631 | A1 | 2/2015 | Cox, III |
| 2015/0251235 | A1 | 9/2015 | Smith et al. |

FOREIGN PATENT DOCUMENTS

| | | |
|---|---|---|
| CN | 1819441 | 8/2006 |
| CN | 101312797 | 11/2008 |
| CN | 103391823 | 11/2013 |
| EP | 0142577 | 5/1985 |
| EP | 2058059 | 5/2009 |
| EP | 2624978 | 4/2015 |
| JP | 58038610 | 3/1983 |
| JP | 58084614 | 5/1983 |
| JP | 50099430 | 6/1985 |
| JP | 2003251408 | 9/2003 |
| WO | 2007060310 | 5/2007 |
| WO | 2012048153 | 4/2012 |

OTHER PUBLICATIONS

Canadian Intellectual Property Office, "Office Action," issued in connection with Canadian Application No. 2,814,077, dated Jun. 12, 2014, 3 pages.

Canadian Intellectual Property Office, "Office Action," issued in connection with Canadian Application No. 2,814,077, dated Mar. 12, 2015, 4 pages.

Canadian Intellectual Property Office, "Office Action," issued in connection with Canadian Application No. 2,643,296, dated May 11, 2015, 4 pages.

European Patent Office, "Extended European Search Report," issued in connection with European Application No. 08019394.9, dated Mar. 26, 2009, 11 pages.

European Patent Office, "Communication Pursuant to Article 94(3) EPC," issued in connection with European Application No. 08019394.9, dated May 14, 2012, 4 pages.

European Patent Office, "Communication pursuant to Article 94(3) EPC," issued in connection with European Application No. 11770655.6, dated Mar. 3, 2014, 5 pages.

Patent Cooperation Treaty, "International Preliminary Report on Patentability," issued in connection with International Application Serial No. PCT/US2011/055160, dated Apr. 18, 2013, 7 pages.

International Searching Authority, "International Search Report," issued in connection with PCT Application No. PCT/US2011/055160, dated Jan. 20, 2012, 4 pages.

International Searching Authority, "Written Opinion of the International Searching Authority," issued in connection with PCT Application No. PCT/US2011/055160, dated Jan. 20, 2012, 6 pages.

The State Intellectual Property Office of China, English version of "First Notification of Office Action," issued in connection with Chinese Patent Application No. 200810173199.2, dated Dec. 31, 2011, 14 pages.

The State Intellectual Property Office of China, English version of "Second Notification of Office Action," issued in connection with Chinese Patent Application No. 200810173199.2, dated Oct. 9, 2012, 7 pages.

The State Intellectual Property Office of China, English version of "Third Notification of Office Action," Issued in connection with Chinese Patent Application No. 200810173199.2, dated May 17, 2013, 13 pages.

The State Intellectual Property Office of China, English version of "Fourth Notification of Office Action," issued in connection with Chinese Patent Application No. 200810173199.2, dated Oct. 8, 2013, 18 pages.

The State Intellectual Property Office of China, English version of "Decision for Rejection," issued in connection with Chinese Patent Application No. 200810173199.2, dated Jan. 27, 2014, 20 pages.

The State Intellectual Property Office of China, English version of "Notice of Decision of Granting Patent Right for Invention," issued in connection with Chinese Patent Application No. 200810173199.2, dated Mar. 25, 2015, 5 pages.

The State Intellectual Property Office of China, English version of "First Notification of Office Action," Issued in connection with Chinese Patent Application No. 201180058444.5, dated Sep. 29, 2014, 26 pages.

The State Intellectual Property Office of China, English version of "Second Notification of Office Action," issued in connection with Chinese Application No. 201180058444.5, dated May 14, 2015, 28 pages.

United States Patent and Trademark Office, "Non-Final Office Action," issued in connection with U.S. Appl. No. 12/260,780, dated Aug. 19, 2011, 18 pages.

United States Patent and Trademark Office, "Final Office Action," issued in connection with U.S. Appl. No. 12/260,780, dated Apr. 25, 2012, 14 pages.

United States Patent and Trademark Office, "Advisory Action," issued in connection with U.S. Appl. No. 12/260,780, dated Jul. 16, 2012, 4 pages.

United States Patent and Trademark Office, "Non-Final Office Action," issued in connection with U.S. Appl. No. 12/260,780, dated Sep. 11, 2013, 14 pages.

United States Patent and Trademark Office, "Final Office Action," issued in connection with U.S. Appl. No. 12/260,780, dated May 15, 2014, 11 pages.

United States Patent and Trademark Office, "Notice of Allowance and Fee(s) Due," issued in connection with U.S. Appl. No. 12/260,780, dated Jul. 7, 2014, 21 pages.

(56) References Cited

OTHER PUBLICATIONS

United States Patent and Trademark Office, "Non-Final Office Action," issued in connection with U.S. Appl. No. 13/267,760, dated Feb. 29, 2012, 18 pages.
United States Patent and Trademark Office, "Final Office Action," issued in connection with U.S. Appl. No. 13/267,760, dated Jul. 31, 2012, 12 pages.
United States Patent and Trademark Office, "Non-Final Office Action," issued in connection with U.S. Appl. No. 13/267,760, dated Apr. 24, 2014, 25 pages.
United States Patent and Trademark Office, "Final Office Action," issued in connection with U.S. Appl. No. 13/267,760, dated Oct. 7, 2014, 19 pages.
United States Patent and Trademark Office, "Notice of Allowance and Fee(s) Due," issued in connection with U.S. Appl. No. 13/267,760, dated Feb. 6, 2015, 19 pages.
United States Patent and Trademark Office, "Corrected Notice of Allowability," issued in connection with U.S. Appl. No. 13/267,760, dated May 5, 2015, 4 pages.
United States Patent and Trademark Office, "Non-Final Office action," issued in connection with U.S. Appl. No. 14/521,249, dated Nov. 27, 2017, 16 pages.
United States Patent and Trademark Office, "Final Office action," issued in connection with U.S. Appl. No. 14/521,249, dated May 18, 2017, 20 pages.
United States Patent and Trademark Office, "Notice of Allowance and Fee(s) Due," issued in connection with U.S. Appl. No. 12/260,780, dated Jul. 25, 2014, 16 pages.
European Patent Office, "Communication under Rule 71(3) EPC, Intention to Grant," issued in connection with European Patent Application No. 11770655.6, dated Oct. 15, 2014, 5 pages.
The State Intellectual Property Office of China, "Third Notification of Office Action," issued in connection with Chinese Patent Application No. 201180058444.5, dated Nov. 17, 2015, 8 pages.
The State Intellectual Property Office, English version of "Fourth Notification of Office Action," issued in connection with Chinese Patent Application No. 201180058444.5, dated May 4, 2016, 7 pages.
The State Intellectual Property Office, English version of "Notice of Decision of Granting Patent Right for Invention," issued in connection with Chinese Patent Application No. 201180058444.5, dated Aug. 4, 2016, 5 pages.
Canadian Intellectual Property Office, "Notice of Allowance," issued in connection with Canadian Patent Application No. 2,643,296, dated Jan. 6, 2016, 1 page.
European Patent Office, "Communication under Rule 71(3) EPC", issued in connection with European Patent Application No. 08 019 394.9, dated Feb. 12, 2016, 6 pages.
IP Australia, "Notice of Acceptance", issued in connection with Australian Patent Application No. 2011311892, dated Mar. 2, 2016, 2 pages.
Canadian Intellectual Property Office, "Examiner's Report", issued in connection with Canadian Patent Application No. 2,814,077, dated Oct. 26, 2015, 3 pages.
Canadian Intellectual Property Office, "Notice of Allowance," issued in connection with Canadian Patent Application No. 2,814,077, dated Sep. 13, 2016, 1 page.
United States Patent and Trademark Office, "Non-Final Office Action," issued in connection with U.S. Appl. No. 14/521,249, dated Oct. 6, 2016, 43 pages.
United States Patent and Trademark Office, "Non-Final Office Action," issued in connection with U.S. Appl. No. 14/718,960, dated Sep. 20, 2017, 13 pages.
United States Patent and Trademark Office, "Final Office Action," issued in connection with U.S. Appl. No. 14/718,960, dated Mar. 21, 2018, 20 pages.
United States Patent and Trademark Office, "Advisory Action," issued in connection with U.S. Appl. No. 14/718,960, dated May 31, 2018, 3 pages.
United States Patent and Trademark Office, "Notice of Allowance and Fee(s) Due," issued in connection with U.S. Appl. No. 14/718,960, dated Nov. 19, 2018, 12 pages.
United States Patent and Trademark Office, "Notice of Panel Decision from Pre-Appeal Brief Review," Issued in connection with U.S. Appl. No. 14/718,960, dated Oct. 5, 2018, 2 pages.

800

1300

| | Dual Uncoiler | Large Lev. | Small Lev. | | | | | | |
|---|---|---|---|---|---|---|---|---|---|
| Usage % | 100% | 50% | 50% | Hrs/Week | Conventional System with Single Motor Configuration | | | | |
| Day Shift Usage kWh | 965 | 3670 | 1465 | 40 | | | | | |
| Swing Shift Usage kWh | 965 | 3670 | 1465 | 40 | | | | | |
| Third Shift Usage kWh | 965 | 3670 | 1465 | 40 | | | | | |
| Weekend Usage kWh | 97 | 370 | 147 | 4 | kWh/WK | Cost/kWh | Total/Wk | Weeks | Total/YR |
| Baseline Weekly kWh | 2992 | 11380 | 4542 | 124 | 19038 | 0.05 | $951.90 | 52 | $49,498.80 |

FIG. 13

1400

| | Dual Uncoiler | Large Lev. | Small Lev. | | | | | | |
|---|---|---|---|---|---|---|---|---|---|
| Usage % | 100% | 50% | 50% | Hrs/Week | Leveler with Two Motors and Regeneration Module | | | | |
| Day Shift Usage kWh | 490 | 1225 | 490 | 40 | | | | | |
| Swing Shift Usage kWh | 490 | 1225 | 490 | 40 | | | | | |
| Third Shift Usage kWh | 490 | 1225 | 490 | 40 | | | | | |
| Weekend Usage kWh | 49 | 123 | 49 | 4 | kWh/WK | Cost/kWh | Total/Wk | Weeks | Total/YR |
| Baseline Weekly kWh | 1519 | 3798 | 1519 | 124 | 6960 | 0.05 | $348.00 | 52 | $18,096.00 |

FIG. 14

APPARATUS AND METHODS TO INCREASE THE EFFICIENCY OF ROLL-FORMING AND LEVELING SYSTEMS

RELATED APPLICATIONS

This patent claims the benefit of U.S. patent application Ser. No. 14/718,960, filed on May 21, 2015, entitled Apparatus and Methods to Increase the Efficiency of Roll-Forming and Leveling Systems, which claims priority to U.S. patent application Ser. No. 13/267,760, filed on Oct. 6, 2011, granted as U.S. Pat. No. 9,050,638, entitled Apparatus and Methods to Increase the Efficiency of Roll-Forming and Leveling Systems, which claims priority to U.S. Provisional Patent Application Ser. No. 61/390,467, filed on Oct. 6, 2010, entitled Methods and Apparatus to Increase the Efficiency of Roll-Forming Systems, all of which are hereby incorporated herein by reference in their entireties.

FIELD OF THE DISCLOSURE

The present disclosure relates generally to roll-forming systems, and more particularly, to apparatus and methods to increase the efficiency of roll-forming and leveling systems.

BACKGROUND

Roll-forming production systems or processes (e.g., roll forming, leveling, etc.) are typically used to manufacture components such as construction panels, structural beams, garage doors, and/or any other component having a formed profile. The moving material may be, for example, a strip material (e.g., a metal) that is pulled from a roll or coil of the strip material and processed using a roll-forming machine or system, or may be a pre-cut strip material that is cut in predetermined lengths or sizes.

Whether a strip material is used in the pre-cut process or post-cut process, the strip material is typically leveled, flattened, or otherwise conditioned prior to entering the roll-forming machine or system to remove or substantially reduce undesirable characteristics of the strip material due to shape defects and internal residual stresses resulting from the manufacturing process of the strip material and/or storing the strip material in a coiled configuration. For example, a material conditioner is often employed to condition the strip material (e.g., a metal) to remove certain undesirable characteristics such as, for example, coil set, crossbow, edgewave and centerbuckle, etc. Levelers are well-known machines that can substantially flatten a strip material (e.g., eliminate shape defects and release the internal residual stresses) as the strip material is pulled from the coil roll.

BRIEF DESCRIPTION OF THE DRAWINGS

FIG. 13 is a graph illustrating example energy costs for a known leveler having a single motor.

FIG. 14 is a graph illustrating example energy costs for an example leveler apparatus having a regeneration module described herein.

DETAILED DESCRIPTION

Figure 1A:
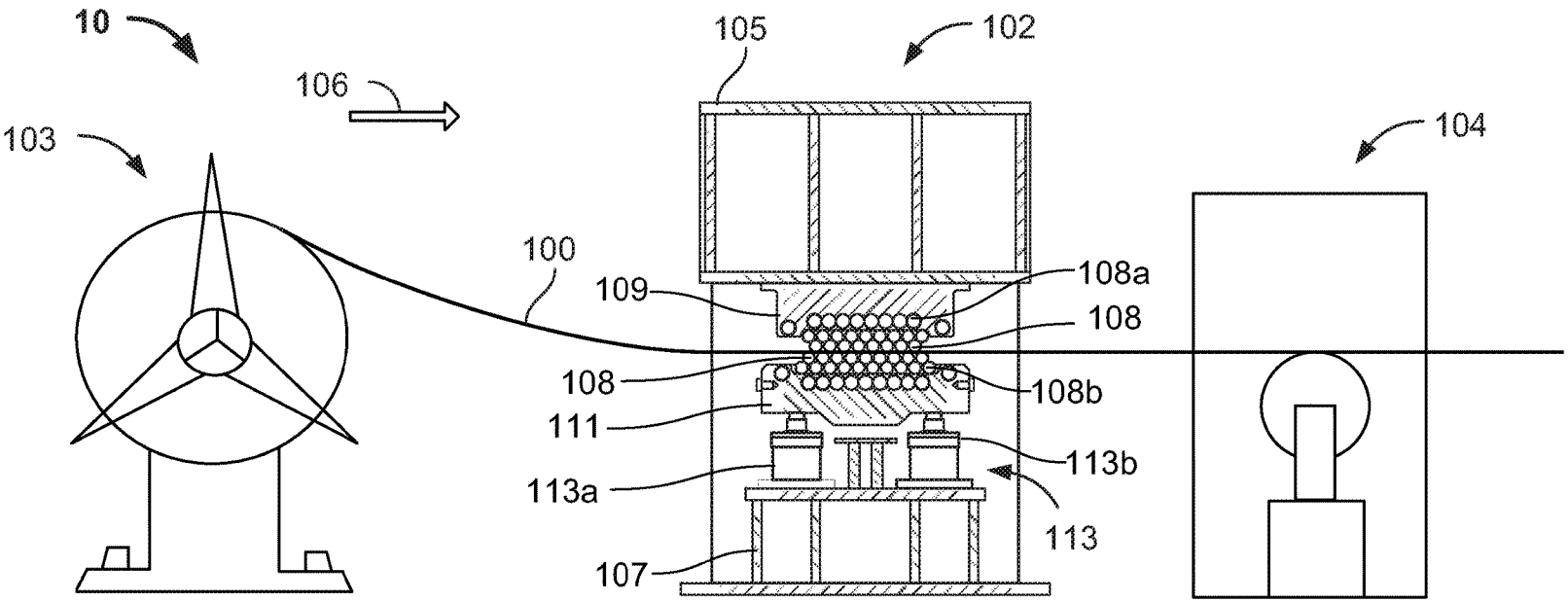
FIG. 1A is a side view of an example production system configured to process a moving strip material using an example dual or split drive leveler.

Roll-forming manufacturing processes are typically used to manufacture components such as construction panels, structural beams, garage doors, and/or any other component having a formed profile. A roll-forming production process may be implemented by using a roll-forming machine having a sequenced plurality of work rolls that receive and form a moving material. Each work roll is typically configured to progressively contour, shape, bend, cut, and/or fold a moving material. Typically, a moving material such as, for example, a strip material (e.g., a metal) is pulled from a roll or coil of the strip material and processed using a roll-forming machine or system or may be a pre-cut strip material that is cut in predetermined lengths or sizes.

The strip material is typically leveled, flattened, or otherwise conditioned prior to entering the roll-forming machine of the production or processing system. In a processing production system, the strip material (e.g., a metal) is typically conditioned via a leveler system to remove certain undesirable characteristics such as, for example, coil set, crossbow, edgewave and centerbuckle, etc. due to shape defects and internal residual stresses resulting from the manufacturing process of the strip material and/or storing the strip material in a coiled configuration. To prepare a strip material for use in production when the strip material is removed from a coil, the strip may be conditioned prior to subsequent processing (e.g., stamping, punching, plasma cutting, laser cutting, roll-forming, etc.). Levelers are well-known machines that can substantially flatten a strip material (e.g., eliminate shape defects and release the internal residual stresses) as the strip material is pulled from the coil roll.

Conventional levelers and/or roll formers can be driven via a single drive system or a multi-drive system. However, unlike the example methods and systems described herein, single and/or multi-drive systems of conventional levelers and/or roll formers typically use a reference speed to control the drives of the system. For example, a multi-drive system may be controlled by operating the drives (e.g., a first motor and a second motor) at a speed that is substantially equivalent to a line speed of the strip material moving through the roll-forming process.

The example methods, apparatus and systems described herein significantly improve the efficiency of a drive system (e.g., conserve energy) of roll-forming process (e.g., leveler machines and/or roll-forming machines) that employ a multi-drive system to process a roll-forming operation. Additionally or alternatively, the example methods, apparatus and systems described herein may regenerate energy during a roll-forming and/or leveling process.

In general, the example apparatus, methods and systems described herein employ a torque value or torque vectoring reference (as opposed to a reference speed) to control a multi-drive system. Controlling a multi-drive system with a torque reference as opposed to a speed reference significantly improves the effectiveness of the system by reducing the power consumption of the multi-drive system. For example, torque vectoring uses a torque reference or value of a master drive rather than a speed value as a command reference to a slave drive of the multi-drive system. When multiple drives are controlled by a torque reference or value, the speeds of the motors of the multi-drive system adjust to meet that torque reference.

In some examples, a torque output of a master drive may be used as a command reference to cause a slave drive to generate an output torque that is different (e.g., a relatively less) than the output torque of the master drive (i.e., torque mismatching). In some examples, a torque output of a master drive may be used as a command reference to cause a slave drive to generate an output torque that is substantially equal to the output torque of the master drive (i.e., torque matching).

For example, using a torque matching application or reference to drive a multi-drive system, as opposed to using a speed reference, significantly increases the efficiency and/or the effectiveness of a roll-forming machine because the effects of mechanical mismatches between the drives of the multi-drive system are substantially reduced or eliminated. In particular, a first motor (e.g., the master drive) of the system does not generate more work to work against another motor (e.g., the slave drive) of the system due to the mechanical mismatches of the process line. Thus, the net effect is less power usage to operate the entire system because significantly less power is being wasted as a result of the mechanical mismatches or losses in the system. Thus, the torque matching application described herein prevents a first drive of the multi-drive system from working against another drive of the multi-drive system. Instead, the drives or motors (e.g., a master drive and/or a slave drive) of the multi-drive system will have a speed mismatch, which is held within an acceptable range. If the speeds of the motors of the multi-drive system are outside of the acceptable range, the motors of the multi-drive system are driven with a matching speed value until the speeds of the motors are within an acceptable range.

In some examples, a torque mismatching application is employed such that the torque output will not be evenly distributed among the drives of a multi-drive system. The torque mismatch between two drives, for example, may cause a first drive (e.g., the master drive) to produce more work, which may cause a second drive (e.g., a slave drive) to operate as a brake so that energy is regenerated in the second drive (e.g., the slave drive). The regenerated energy may be used to power or drive the first drive (e.g., the master drive), thereby increasing the overall efficiency of the drive system.

In general, during operation, a first drive (e.g., a master drive) of a multi-drive system described herein receives a command to operate at a reference speed value (e.g., a process material line speed). A torque reference of the first drive is measured when the first drive is operating at the reference speed. A second drive (e.g., a slave drive) receives a command to generate a torque output that is measured or based on the torque reference of the first drive. For example, in a torque matching application, the slave drive may receive a command to generate an output torque that is equal to the torque output or reference of the first drive (i.e., a one-to-one ratio). For example, a leveling apparatus and/or a roll-former apparatus of a roll-forming system may be configured to operate via the torque matching application.

In contrast, in a torque mismatching application, the slave drive receives a command to generate an output torque that is within approximately one percent and five percent of the torque output or reference of the first drive. For example, the slave drive receives a command to generate an output torque that is between one percent and five percent less than the output torque generated by the master drive. For example, in a leveling apparatus, a plurality of exit rolls may be driven by a master drive and a plurality of entry rolls may be driven by a slave drive, where the torque output generated by the slave drive is relatively less than the torque output generated by the master drive to provide a torque output mismatch between the master drive and the slave drive. In this manner, the master drive imparts a negative rotational torque to the slave drive, where the rotational torque has a magnitude greater than a magnitude of a torque output of the slave drive system. As a result, the torque mismatch (e.g., a greater torque imparted to the exit rolls than the entry rolls) causes the slave drive to produce or regenerate electric energy. This regenerated electric energy may be fed back into the system via, for example, a bus and used by either and/or both of the drives.

Additionally or alternatively, the example roll-forming systems described herein may include a feedback system to detect if a speed of the second drive (e.g., the slave drive) is within an acceptable limit or range when the first drive or master drive is operating at a reference speed value and the slave drive is operating at either the torque mismatch value or the torque matching value. For example, if the speed of the second drive (e.g., the slave drive) is within an acceptable speed limit or range when producing a torque output measured or based on the torque output or reference of the first drive (e.g., the master drive), then the system continues to operate the second drive based on the torque reference of the first drive. If the speed of the second drive (e.g., the slave drive) is not within an acceptable speed limit or range when commanded to operate based on the torque reference of the first drive (e.g., the master drive), then the system operates the second drive (e.g., the slave drive) based on a speed reference of the first drive (e.g., the speed of the master drive) (i.e., speed matching).

FIG. 1A is a side view an example production system 10 configured to process a moving strip material 100 using an example dual or split drive leveler system 102 (i.e., the split drive leveler 102). In some example implementations, the example production system 10 may be part of a continuously moving strip material manufacturing system, which may include a plurality of subsystems that modify, condition or alter the strip material 100 using processes that, for example, level, flatten, punch, shear, and/or fold the strip material 100.

For example, the strip material 100 may be subsequently processed into a construction panel, a structural beam and/or any other component having a formed profile via a roll forming machine such as, for example, the roll-forming machine 900 of FIG. 9. In alternative example implementations, the split drive leveler 102 may be implemented as a standalone system.

In the illustrated example, the split drive leveler 102 may be placed between an uncoiler 103 and a subsequent operating unit 104. The strip material 100 travels from the uncoiler 103, through the leveler 102, and to the subsequent operating unit 104 in a direction generally indicated by arrow 106. The subsequent operating unit 104 may be a continuous material delivery system that transports the strip material 100 from the split drive leveler 102 to a subsequent operating process such as, for example, a punch press, a shear press, a roll former, etc. In other example implementations, sheets precut from, for example, the strip material 100 can be sheet-fed through the leveler 102.

The split drive leveler 102 has an upper frame 105 and a bottom frame 107. The upper frame 105 includes an upper backup 109 mounted thereon and the bottom frame 107 includes an adjustable backup 111 mounted thereon. The adjustable backup 111 may be adjusted relative to the upper backup 109 via a hydraulic system 113 that includes, for example, hydraulic cylinders 113*a* and 113*b*. As shown in FIG. 1A, the upper backup 109 is non-adjustable and fixed to the upper frame 105. However, in other example implementations, the upper backup 109 may be adjustable. As most clearly shown in FIG. 1B, the split drive leveler 102 includes a plurality of work rolls 108 disposed between the upper frame 105 and the bottom frame 107. In this example, the split drive leveler 102 includes a plurality of backup work rolls 108*a* and a plurality of intermediate work rolls 108*b*.

Figure 1B:
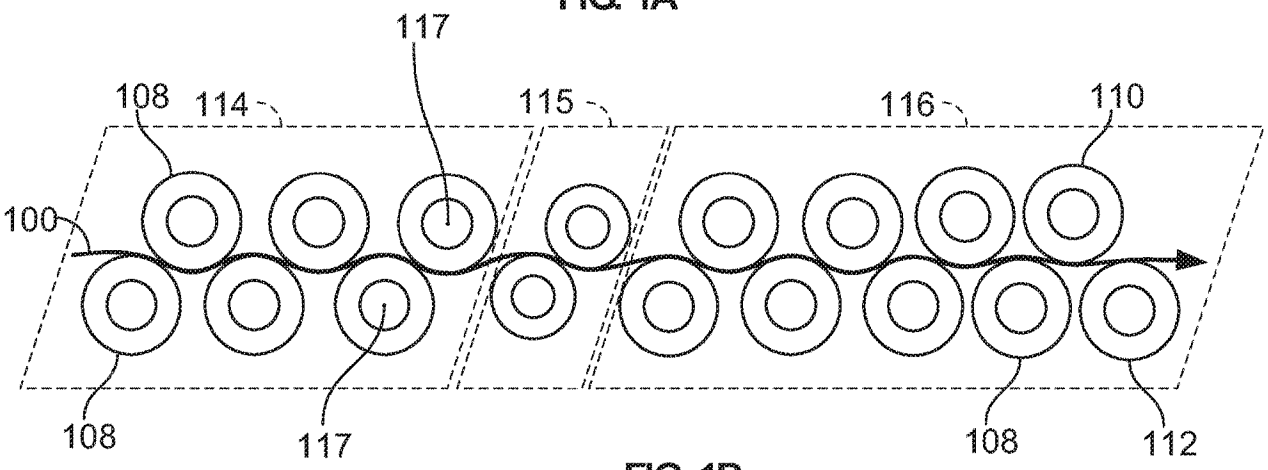
FIG. 1B illustrates a partial enlarged view of the example split drive leveler of FIG. 1A.

FIG. 1B illustrates the plurality of work rolls 108 of the split drive leveler 102 arranged as a plurality of upper work rolls 110 and lower work rolls 112. The work rolls 108 can be implemented using steel or any other suitable material. The upper work rolls 110 are offset relative to the lower work rolls 112 so that the strip material 100 is fed through the upper and lower work rolls 110 and 112 in an alternating manner. In the illustrated example, the work rolls 110 and 112 are partitioned into a plurality of entry work rolls 114 and a plurality of exit work rolls 116. As described in greater detail below, the entry work rolls 114 are driven independent of the exit work rolls 116 and the entry work rolls 114 can be controlled independent of the exit work rolls 116. In this manner, the exit work rolls 116 can apply relatively more rolling torque to the strip material 100 than the amount of rolling torque applied by the entry work rolls 114. Additionally or alternatively, the exit work rolls 116 can be operated at a relatively higher speed than the entry work rolls 114. In other example implementations, the example split drive leveler 102 can be provided with a plurality of idle work rolls 115 that can be positioned between and in line with the entry work rolls 114 and the exit work rolls 116. The idle work rolls 115 are typically non-driven but can be driven in some implementations.

Leveling and/or flattening techniques are implemented based on the manners in which the strip material 100 reacts to stresses imparted thereon (e.g., the amount of load or force applied to the strip material 100). For example, the extent to which the structure and/or characteristics of the strip material 100 change is, in part, dependent on the amount of load, force, or stress applied to the strip material 100. To impart a load, force or stress to the strip material 100, the work rolls 108 apply a plunge force to the strip material 100 to cause the material 100 to wrap (at least partially) around the work rolls 108. A work roll plunge can be varied by changing a distance between center axes 117 and of the work rolls 108 via, for example, the adjustable backup 111 and the hydraulic system 113. For example, a plunge force can be increased by decreasing the distance between the center axes 117 of the respective upper and lower work rolls 110 and 112 along a vertical plane. Similarly, a plunge force can be decreased by increasing the distance between the center axes 117 of the respective upper and lower work rolls 110 and 112 along vertical plane.

In the illustrated example, the split drive leveler 102 uses the adjustable backup 111 (i.e., adjustable flights) to increase or decrease the plunge depth between the upper and the lower work rolls 110 and 112. Specifically, the hydraulic cylinders 113*a* and 113*b* move the bottom backup 111 via adjustable flights to increase or decrease the plunge of the upper and the lower work rolls 110 and 112. In other example implementations, the plunge of the work rolls 110 and 112 can be adjusted by moving the upper backup 109 with respect to the bottom backup 111 using, for example, motor and screw (e.g., ball screw, jack screw, etc.) configurations.

To substantially reduce or eliminate residual stresses, the strip material 100 is stretched beyond an elastic phase to a plastic phase of the strip material 100. That is, the strip material 100 is stretched so that the plastic region extends through the entire thickness of the strip material 100. Otherwise, when the plunge force F applied to a portion of the strip material 100 is removed without having stretched portions of it to the plastic phase, the residual stresses remain in those portions of the strip material 100 causing the material 100 to return to its shape prior to the force being applied. In such an instance, the strip material 100 has been flexed but has not been bent.

The amount of force required to cause a strip material to change from an elastic condition to a plastic condition is commonly known as yield strength. Yield strengths of metals having the same material formulation are typically the same, while metals with different formulations have different yield strengths. The amount of plunge force F needed to exceed the yield strength of a material can be determined based on the diameters of the work rolls 108, the horizontal separation between neighboring work rolls 108, a modulus of elasticity of the material, yield strength of the material(s), a thickness of the material, etc.

Referring to FIGS. 1A and 1B, the plunge of the entry work rolls 114 is set to deform the strip material 100 beyond its yield strength. In the illustrated example, the plunge of the entry work rolls 114 is relatively greater than the plunge of the exit work rolls 116. In some example implementations, the plunge of the exit work rolls 116 can be set to not deform the strip material 100 by any substantial amount but instead only adjust the shape of the strip material 100 to a flat shape. For example, the plunge of the exit work rolls 116 may be set so that a separation gap between opposing surfaces of the upper and lower work rolls 110 and 112 is substantially equal to the thickness of the strip material 100.

In operation, the split drive leveler 102 receives the strip material 100 from the uncoiler 103 and/or precut sheets can be sheet-fed though the leveler 102. A user may provide material thickness and yield strength data via, for example, a controller user interface (e.g., a user interface of the controller 302 of FIG. 3) to cause a controller to automatically adjust the work rolls 110 and 112 to a predetermined entry and exit work roll plunge depth corresponding to the particular strip material data provided by the user. For example, a controller may control the hydraulic cylinders 113*a* and 113*b* to adjust the adjustable backup 111 to control deflection and/or tilt position of the work rolls 112 relative to the work rolls 110 to determine the location and manner in which the strip material 100 is conditioned. In this manner, less pressure may be applied to ends of the work rolls 112 so that the centers of the work rolls 112 apply more pressure to the strip material 100 than that applied to the edges. By adjusting the lower backup 111 differently across the width of the lower work rolls 112, different plunge forces can be applied across the width of the strip material 100 to correct different defects (e.g., coil set, crossbow, edgewave and centerbuckle, etc.) in the strip material 100.

Further, the exit work rolls 116 are driven to provide a greater rolling torque to the strip material 100 than the entry work rolls 114, thereby causing the exit work rolls 116 to pull or stretch the strip material 100 through the leveler 102 and more effectively condition the strip material 100. The strip material 100 may be taken away or moved away in a continuous manner from the leveler 102 by the second operating unit 104.

Alternatively, the exit work rolls 116 may be driven to provide a rolling torque to the strip material 100 that is substantially equal to a rolling torque provided to the strip material 100 by the entry work rolls 114. In this manner, driving the first and second work rolls 114 and 116 at substantially the same torque significantly increases the efficiency of the leveler 102.

When the strip material 100 is moving through the leveler 102, external factors impart a load on the leveler system 102. For example, the plunge force provided by the work rolls 108, thickness of the strip material 100, yield stress of the strip material 100, stock wheel brake, friction of the gearing etc., impart or exert a load on the system 10. The system 10 overcomes this load to move the strip material 10 through the leveler 102.

Figure 2:
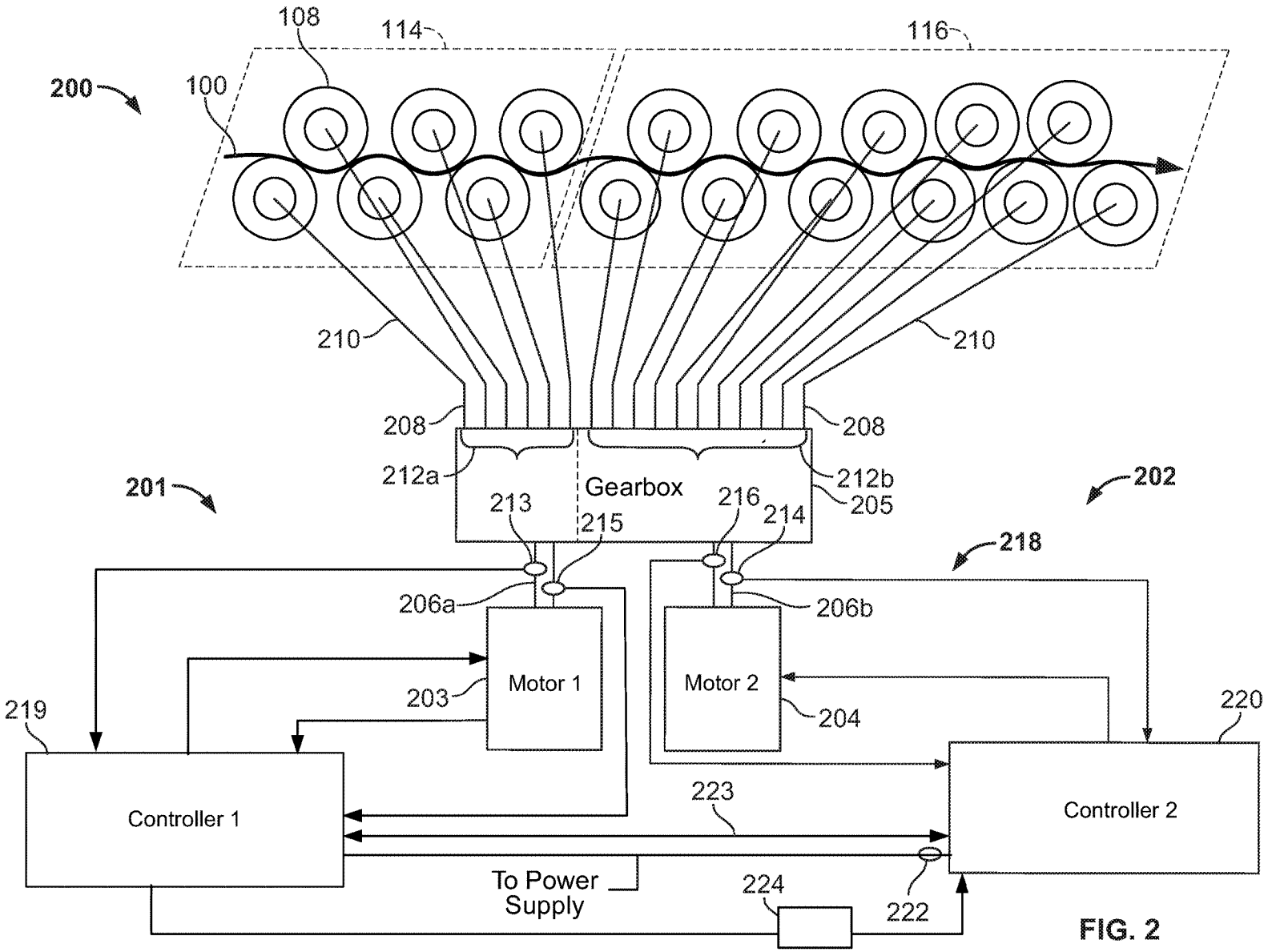
FIG. 2 illustrates an example system that may be used to drive the dual or split drive leveler of FIG. 1A.

FIG. 2 illustrates an example drive system 200 to drive the split drive leveler 102 of FIG. 1A. In the illustrated example, the split drive leveler 102 (FIG. 1) includes a multi-drive system having a first drive system 201 and a second drive system 202. The first drive system 201 includes a first motor 203 (e.g., a slave motor) to drive the entry work rolls 114 and the second drive system 202 includes a second motor 204 (e.g., a master drive) to drive the exit work rolls 116. The first motor 203 and/or the second motor 204 may be implemented using any suitable type of motor such as, for example, an AC motor (e.g., a 3-phase induction motor), a variable frequency motor, a D.C. motor, a stepper motor, a servo motor, a hydraulic motor, etc. Although not shown, the drive system 200 and/or the leveler 102 may include one or more additional drive systems or motors (i.e., in addition to drive systems 201 and 202 and motors 203 and 204).

In the illustrated example, to transfer rotational torque from the motors 203 and 204 to the work rolls 108, the example drive system 200 is provided with a gearbox 205. The gearbox 205 includes two input shafts 206*a* and 206*b*, each of which is operatively coupled to a respective one of the motors 203 and 204. The gearbox 205 also includes a plurality of output shafts 208, each of which is used to operatively couple a respective one of the work rolls 108 to the gearbox 205 via a respective coupling 210 (e.g., a drive shaft, a gear transmission system, etc.). In other example implementations, the couplings 210 can alternatively be used to operatively couple the output shafts 208 of the gearbox 205 to the backup rolls 108*a* of the leveler 102 and/or the intermediate work rolls 108*b* of the leveler 102 which, in turn, drive the work rolls 108.

The output shafts 208 of the gearbox 205 include a first set of output shafts 212*a* and a second set of output shafts 212*b*. The first motor 203 drives the first set of output shafts 212*a* and the second motor 204 drives the second set of output shafts 212*b*. Specifically, the input shafts 206*a* and 206*b* transfer the output rotational torques and rotational speeds from the motors 203 and 204 to the gearbox 205, and each of the output shafts 212*a* and 212*b* of the gearbox 205 transmits the output torques and speeds to the work rolls 108 via respective ones of the couplings 210. In this manner, the output torques and speeds of the motors 203 and 204 can be used to drive the entry work rolls 114 and the exit work rolls 116 at different rolling torques and speeds.

Additionally, although one gear box 205 is illustrated, the gear box 205 does not mechanically couple the first motor 203 to the second motor 204. Instead, the first motor 203 of the first drive system 201 is only mechanically coupled to the second motor 204 of the drive system 202 via the strip material 100 moving between the entry rolls 114 and the exit rolls 116.

In other example implementations, two gearboxes may be used to drive the entry and exit work rolls 114 and 116. In such example implementations, each gear box has a single input shaft and a single output shaft. In this implementation, each input shaft is driven by a respective one of the motors 203 and 204, and each output shaft drives its respective set of the work rolls 108 via, for example, a chain drive system, a gear drive system, etc. In yet other example implementations, each work roll 108 can be driven by a separate, respective drive system (e.g., drive systems 201 or 202) or motor via, for example, a shaft, an arbor, a spindle, etc., or any other suitable drive. Thus, each work roll of the entry work rolls 114 and each work roll of the exit work rolls 116 may be independently driven by a separate motor, where each separate motor may be driven in direct relation or based on an output parameter of one or more of the other motors as described herein. In yet other examples, the drive systems 201 and 202 may each include a plurality of motors, where one motor of the plurality of motors is a master drive and the other ones of the plurality of motors are slave drives.

In the illustrated example of FIG. 2, the split drive leveler 102 is provided with torque sensors 213 and 214 to monitor the output torques of the first motor 203 and the second motor 204, respectively. The torque sensor 213 can be positioned on or coupled to the shaft 206*a* of the first motor 203, and the torque sensor 214 can be positioned on or coupled to the shaft 206*b* of the second motor 204. The torque sensors 213 and 214 may be implemented using, for example, rotary strain gauges, torque transducers, encoders, rotary torque sensors, torque meters, etc. In other example implementations, other sensor devices may be used instead of torque sensors to monitor the torques of the first and second motors 203 and 204. In some example implementations, the torque sensors 213 and 214 can alternatively be positioned on shafts or spindles of the work rolls 108 to monitor the rolling torques of the entry work rolls 114 and the exit work rolls 116. Alternatively, drive system 201 and/or 202 (e.g., a controller) may receive a signal from directly from the motor's drive that corresponds to the output torques of the second motor 204 or the first motor 203.

Alternatively or additionally, the split drive leveler 102 can be provided with speed sensors or encoders 215 and/or 216 to monitor the output speeds of the first motor 203 and/or the second motor 204. The encoders 215 and 216 can be engaged to and/or coupled to the shafts 206*a* and 206*b*, respectively. The encoders 215 and 216 may be implemented using, for example, an optical encoder, a magnetic encoder, etc. In yet other example implementations, other sensor devices may be used instead of an encoder to monitor the speeds of the motors 203 and 204 and/or the entry and exit work rolls 114 and 116.

In the illustrated example, the example drive system 200 includes a control system 218 to control the torque and/or speed of the first and/or second motors 203 and 204. In this example, the control system 218 includes a first controller 219 (e.g., a variable frequency drive) to control the torque and/or speed of the first motor 203 and a second controller 220 (e.g., a variable frequency drive) to control the torque and/or speed of the second motor 204. The first and second controllers 219 and 220 are communicatively coupled via a common bus 223.

As discussed in greater detail below, the second controller 220 monitors the output torque of the second motor 204 (e.g., the master motor) and commands the second motor 204 to operate at a first command reference such as a reference speed value received by the second controller 220. The first controller 219 or determines a second command reference based on the first output parameter or output torque of the second motor. The first controller 219 controls or causes the first motor 203 to produce relatively less output torque than the second motor 204 (e.g., a significantly lesser torque compared to the torque output of the second motor 204). In other words, the torque outputs of the first and second motors 203 and 204 are controlled to provide different output torques (i.e., a torque mismatch) such that the output torque of the second motor 204 is greater than the output torque of the first motor 203 by a predetermined value or percentage. For example, the first motor 203 can be controlled to produce a first output torque equal to a torque ratio value that is less than one multiplied by the output torque of the second motor 204. Additionally or alternatively, the control system 218 can control the output speeds of the first and second motors 203 and 204 to control the speeds of the entry work rolls 114 and exit work rolls 116. For example, the first controller 219 can control the speed of the first motor 203 so that it operates at a speed that is substantially equal to the speed of the second motor 204, or a speed that is less than the speed of the second motor 204 (e.g., a first speed to second speed ratio value that is less than one or some other speed mismatch ratio or predetermined value).

As shown, the first controller 219 is electrically coupled to the second controller 219. Further, the example control system 218 also includes an energy regeneration module 224 (e.g., implemented via an electric circuit 800 of FIG. 8).

During operation, a torque mismatch between the first and second motors 203 and 204, where the second motor 204 (e.g., the master drive) is controlled to provide a relatively greater torque output than the first motor 203 (e.g., the slave drive), causes the second motor 204 to impart a pulling force or effect on the first motor 203 because the second motor 204 is coupled to the exit rolls 116 and the first motor 203 is coupled to the entry rolls 114. Due to the torque mismatch between the first motor 203 and the second motor 204, the second motor 204 may cause the first motor 203 to overhaul and act like a brake. In other words, the second motor 204 provides a pulling effect to the strip material 100 which, in turn, provides a pulling effect on the first motor 203 (via the entry rolls 114) because the second motor 204 is operatively coupled to the first motor 203 via the strip material 100 being pulled through the leveler 102. As a result, the first motor 203 is operated as a generator during braking and the electrical energy output is supplied to an electrical load (e.g., the second motor 204) via, for example, the circuit 800 of FIG. 8.

Such a braking effect may occur during operation because the pulling effect may impart a rotational force or negative torque to the shaft 206*a* of the first motor 203. In other words, the second motor 204 provides a mechanical source of torque input back into the first motor 203 (or the system 200). The magnitude of this negative torque may be greater than a magnitude of positive torque output (or the command torque) of the first motor 203 provided by the current draw of the first motor 203. In other words, the first controller 219 may command the first motor 203 to provide a command output torque (a positive torque) that is a less than the torque output of the second motor 204 (i.e., the mismatch torque). Thus, the first motor 203 draws a current to provide the command output torque. A difference in this torque provides a mechanical input torque to the shaft 206*a* of the first motor 203. Thus, this mechanical input torque causes the first motor 203 to operate as a brake when the magnitude of a negative torque on the shaft 206*a* is greater than the magnitude of a command torque that is produced by the first motor 203 based on the electrical current draw. This braking action creates a generator effect that causes the first motor 203 to produce or regenerate electric power.

The transfer of energy (e.g., the regenerated electric power) to a load provides the braking effect. The energy regeneration module 224 is electrically coupled to the second drive system 202 via the controllers 219 and 220 to transfer the regenerated current to the second motor 204 and/or the first motor 203, thereby increasing the efficiency of the drive system 200. For example, the first drive system 201 regenerates electric energy and includes the energy regeneration module 224 to provide the regenerated electric energy to the second drive system 202, thereby conserving energy and providing a more efficient system (e.g., a fifteen to fifty percent more efficient system) in addition to improving the effectiveness of leveling the strip material 100 when driving the second motor 204 at a higher output torque than the first motor 201.

Further, driving the exit rolls 116 at a torque that is greater the torque of the entry roll 114 causes the second motor 204 to pull or further stretch the strip material 100 through the leveler 102. Such stretching of the strip material 100 increases the effectiveness of the leveler 102 to level the strip material 100 by removing a relatively greater amount of residual stresses and/or defects that may be trapped within the strip material 100. In particular, by maintaining the tension in this manner, the entry work rolls 114 can apply sufficient plunge force against the strip material 100 to stretch the material beyond the elastic phase into the plastic phase, thereby decreasing or eliminating internal stresses of the strip material 100. Controlling the drive system 200 in this manner enables more effective conditioning (e.g., leveling) of the strip material 100 than many known systems.

The load imparted to the second motor 204 may be monitored so that a load imparted on the second motor 204 is not substantially greater than a full-load current rating of the second motor 204. For example, the load imparted on the second drive motor 204 may be directly proportional to an amount of plunge force exerted on the first and second work rolls 114 and 116. The rotational torque required to rotate the work rolls 108 is directly proportional to the plunge force of the work rolls 108 because increasing the plunge force increases the frictional forces between the work rolls 108 and the material 100. Thus, increasing the plunge force, in turn, increases a load on the drive system 200.

To overcome the load resulting from the plunge force, the motor (e.g., the second motor 204) produces sufficient mechanical power (e.g., horsepower) to provide an output torque that is greater than the load to rotate the plunged work roll. The greater the plunge of the work rolls 108, the greater the amount of mechanical power a motor must produce to deform the strip material 100 to its plastic phase. Additionally, other factors contribute to a load that the drive system 200 must overcome. For example, along with plunge force exerted on the strip material 100, other external factors that contribute to the load of the system 200 may include, for example, stock wheel brake, strip material thickness, friction, mechanical losses, etc. Thus, the drive system 200 overcomes this load to process the strip material 100 through the leveler 102.

The mechanical power generated by a motor is directly proportional to the electrical power consumption of the motor, which can be determined based on the constant voltage applied to the motor and the variable current drawn by the motor in accordance with its mechanical power needs. Accordingly, the output torque of a motor can be controlled by controlling an input electrical current of the motor. Under the same principle, the output torque of a motor can be determined by measuring the electrical current drawn by the motor.

To monitor the current draw of the second motor 204, a current sensor 222 is disposed between a power source (not shown) and the second motor 204 to measure the current of the second motor 204. In this manner, a load imparted on the second motor 204 can be compared to the measured electrical current drawn by the second motor 204. For example, to determine whether a load imparted on the second motor 204 is within a desired or acceptable range, the current draw of the second motor 204 can be measured when the second motor 204 is operating at a specific torque and compared to the full load current rating of the second motor 204. For example, the load exerted on the second motor 204 may be within an acceptable range if the current drawn by the second motor 204 at that particular torque output is within a desired or predetermined percentage (e.g., within 5 percent) of the full load current rating of the second motor 204. Additionally or alternatively, in other examples, the current draw of the first motor 203 may also be measured to determine the load of the first motor 203.

Figure 3:
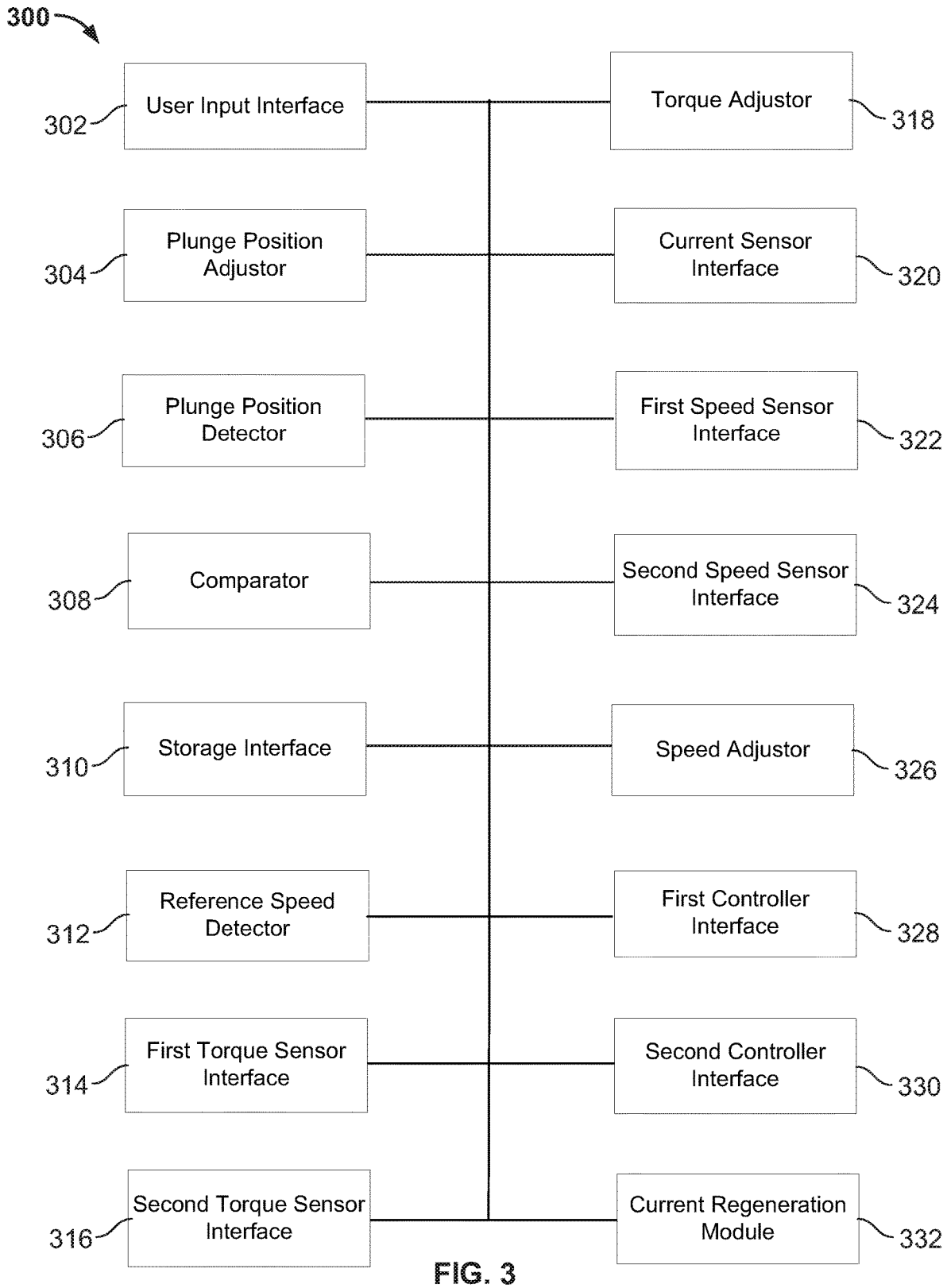
FIG. 3 is a block diagram of an example apparatus that may be used to implement the example methods described herein.

FIG. 3 is a block diagram of an example apparatus 300 that may be used to implement the example methods described herein. In particular, the example apparatus 300 may be used in connection with and/or may be used to implement the example system 200 of FIG. 2 or portions thereof to provide a torque output mismatch between the first and second motors 203 and 204 so that the second motor 204 can generate relatively more torque than the first motor 203 (e.g., a second output torque to first output torque ratio value that is greater than one and/or a predetermined value). The example apparatus 300 may also be used to implement a feedback system to adjust the mismatch torque ratio of the first and second motors 203 and 204 if the load on the second motor 204 is not within a predetermined range based on a full-load current rating comparison of the second motor 204. For example, the feedback system ensures that the second motor 204 does not operate above a specific operating rating (e.g. full-load current rating) of the second motor 204. Additionally or alternatively, the example apparatus 300 may be used to adjust the output speed of the second motor 204 so that the second motor 204 can operate at a relatively faster speed than the first motor 203 (i.e., a second speed to first speed ratio value that is greater than one and/or a predetermined value). For example, if the torque mismatch ratio between the first and second motors 203 and 204 is outside a desired or predetermined range, then the speeds of the first and second motors 203 and 204 are controlled. For example, the first motor 203 may be controlled to operate at a relatively lower speed than the speed of the second motor 204 or, alternatively, at a speed substantially equal to the speed of the second motor 204.

The example apparatus 300 may be implemented using any desired combination of hardware, firmware, and/or software. For example, one or more integrated circuits, discrete semiconductor components, and/or passive electronic components may be used. Additionally or alternatively, some or all of the blocks of the example apparatus 300, or parts thereof, may be implemented using instructions, code, and/or other software and/or firmware, etc. stored on a machine accessible or readable medium that, when executed by, for example, a processor system (e.g., the processor system 510 of FIG. 5) perform the operations represented in the flowchart of FIGS. 4A and 4B. Although the example apparatus 300 is described as having one of each block described below, the example apparatus 300 may be provided with two or more of any block described below. In addition, some blocks may be disabled, omitted, or combined with other blocks.

As shown in FIG. 3, the example apparatus 300 includes a user input interface 302, a plunge position adjustor 304, a plunge position detector 306, a comparator 308, a storage interface 310, a reference speed detector 312, a first torque sensor interface 314, a second torque sensor interface 316, a torque adjustor 318, a current sensor interface 320, a first speed sensor interface 322, a second speed sensor interface 324, a speed adjustor 326, a first controller interface 328, a second controller interface 330, and a current regeneration module 332, all of which may be communicatively coupled as shown or in any other suitable manner.

The user input interface 302 may be configured to determine strip material characteristics such as, for example, a thickness of the strip material 100, the type of material (e.g., aluminum, steel, etc.), etc. For example, the user input interface 302 may be implemented using a mechanical and/or electronic graphical user interface via which an operator can input the characteristics of the strip material 100 such as, for example, the type of material, the thickness of the material, the yield strength of the material, etc.

The plunge position adjustor 304 may be configured to adjust the plunge position of the work rolls 108. The plunge position adjustor 304 may be configured to obtain strip material characteristics from the user input interface 302 to set the vertical positions of the work rolls 108. For example, the plunge position adjustor 304 may retrieve predetermined plunge position values from the storage interface 310 and determine the plunge position of the work rolls 108 based on the strip material input characteristics from the user input interface 302 and corresponding plunge depth values stored in the plunge force data structure. The plunge position adjustor 304 may adjust the upper and lower work rolls 110 and 112 to increase or decrease the amount of plunge between the upper and lower work rolls 110 and 112 via, for example, the hydraulic system 113 (FIG. 2). Additionally or alternatively, an operator can manually select the plunge depth of the work rolls 108 by entering a plunge depth valve via the user input interface 302.

Additionally or alternatively, the plunge position detector 306 may be configured to measure the plunge depth position values of the work rolls 108. For example, the plunge position detector 306 can measure the vertical position of the work rolls 108 to achieve a particular plunge depth (e.g., the distance between the centers of work rolls 108). The plunge position detector 306 can then communicate this value to the comparator 308. Based on the plunge depth values stored in a look-up table (not shown) in association with the characteristics of the strip material 100 received from the user input interface 302, the plunge position adjustor 304 adjusts the plunge depth of the work rolls 108. The plunge depth contributes to an external load imparted on the drive system 200 of FIG. 2.

Figure 5:
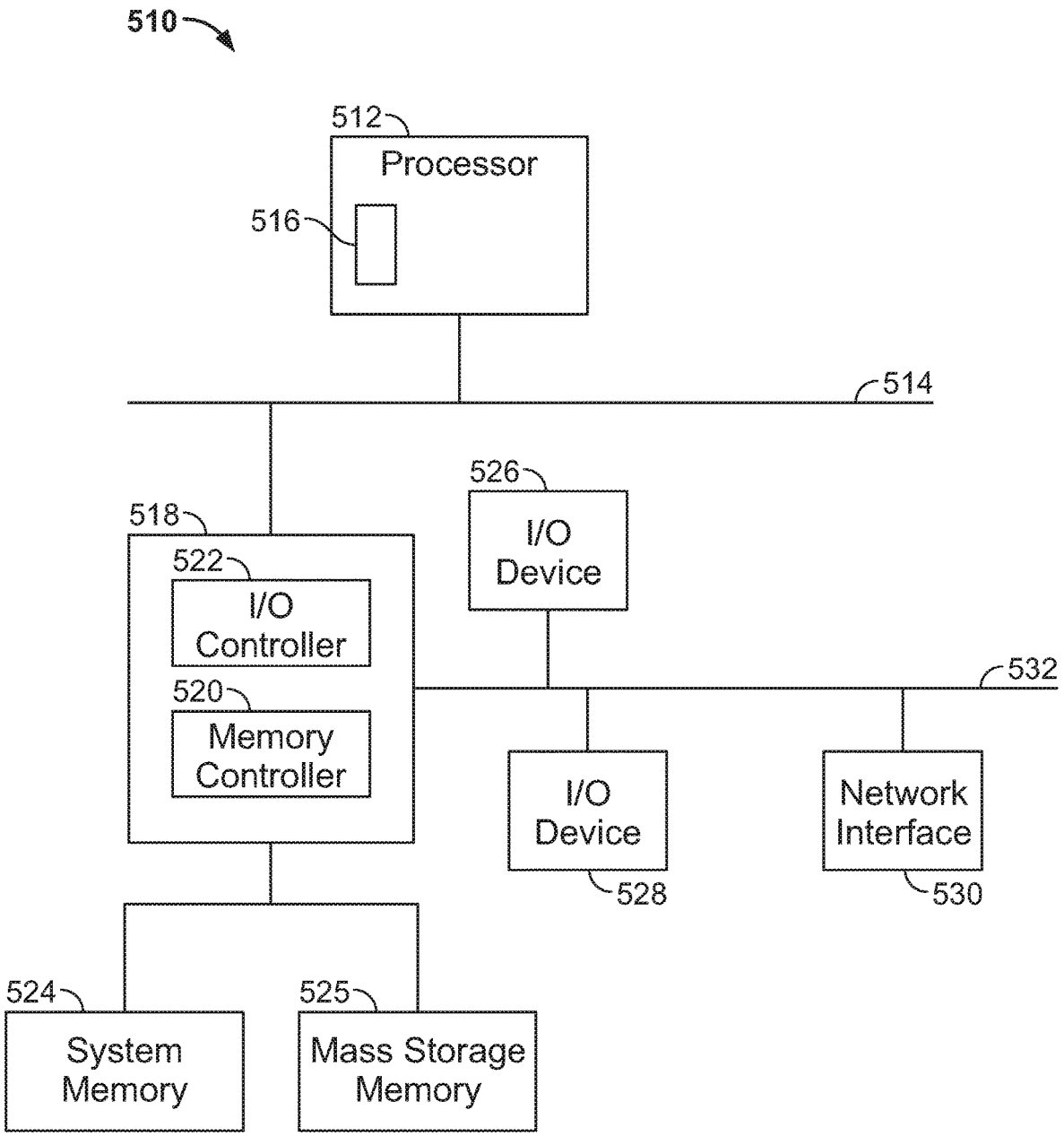
FIG. 5 is a block diagram of an example processor system that may be used to implement the example methods and apparatus described herein.

The storage interface 310 may be configured to store data values in a memory such as, for example, the system memory 524 and/or the mass storage memory 525 of FIG. 5. Additionally, the storage interface 310 may be configured to retrieve data values from the memory (e.g., from the data structure). For example, the storage interface 310 may access the data structure to obtain plunge position values from the memory and communicate the values to the plunge position adjustor 304.

The reference speed detector 312 may be communicatively coupled to an encoder or speed measurement device that measures a reference speed value. For example, the reference speed detector 312 may obtain, retrieve or measure a reference speed based on the speed of the strip material 100 traveling through the leveler 102 (e.g., a line speed). Additionally or alternatively, the reference speed detector 312 receives a reference speed of the strip material 100 from the user interface 302. Additionally or alternatively, the reference speed detector 312 may be configured to send the reference speed measurement value to the comparator 308. Additionally or alternatively, the reference speed detector 312 may then send the reference speed measurement value to the second controller interface 330 and the second controller interface 330 may then command the second motor 204 to operate at the reference speed measurement value provided by the reference speed detector 312.

The first torque sensor interface 314 may be communicatively coupled to a torque sensor or torque measurement device such as, for example, the torque sensor 213 of FIG. 2. The first torque sensor interface 314 can be configured to obtain the torque value of, for example, the first motor 203 and may periodically read (e.g., retrieve or receive) torque measurement values from the torque sensor 213. The first torque sensor interface 314 may be configured to then send the torque measurement value to the comparator 308. Additionally or alternatively, the second torque sensor interface 314 may be configured to send the torque measurement values to the first and/or second controller interfaces 328 and 330.

The second torque sensor interface 316 may be communicatively coupled to a torque sensor or torque measurement device such as, for example, the second torque sensor 214 of FIG. 2. The second torque sensor interface 316 can be configured to obtain the torque value of, for example, the second motor 204 and may periodically read torque measurement values from the torque sensor 214. For example, the second torque sensor interface 316 may be configured to then send the torque measurement values to the comparator 308 when the second motor 204 is operating at the reference speed provided by the reference speed detector 312. Additionally or alternatively, the second torque sensor interface 316 may be configured to send the torque measurement values to the first and/or second controller interfaces 328 and 330.

The comparator 308 may be configured to perform comparisons based on the torque values received from the first torque sensor interface 314 and the second torque sensor interface 316 to determine if the first motor 203 is operating within a predetermined torque mismatch ratio or value of the measured output torque of the second motor 204 when the second motor 204 is operating at the reference speed provided by the reference speed detector 312. For example, the comparator 308 may be configured to compare the torque values measured by the first torque sensor interface 314 with the torque values measured by the second torque sensor interface 316 to determine if the first motor 203 is generating a torque output that is within the predetermined torque mismatch ratio or value. For example, the comparator 308 compares the torque measurement values provided by the first and second torque sensor interfaces 314 and 316 to determine if the first motor 203 is operating at relatively less output torque than the second motor 204 (e.g., a second torque output to first torque output ratio value that is greater than one). The comparator 308 may then communicate the results of the comparisons to the torque adjustor 318.

The torque adjustor 318 may be configured to adjust (e.g., increase or decrease) the torque of the first motor 203 based on the comparison results obtained from the comparator 308. For example, if the comparison results obtained from the comparator 308 indicate that a torque mismatch ratio between the torque measurement value measured by the second torque sensor interface 316 and the torque measurement value measured by the first torque sensor interface 314 is less than or greater than a predetermined torque ratio value (e.g., a torque mismatch ratio value of between greater than one), the torque adjustor 318 can adjust the torque of the first motor 203 until a torque mismatch ratio between the torque measurement value measured by the first torque sensor interface 314 and the torque measurement value measured by the second torque sensor interface 316 is within the predetermined torque ratio value or range.

Additionally or alternatively, the current sensor interface 320 may be communicatively coupled to a current sensing device such as, for example, the current sensor 222 of FIG. 2. The current sensor interface 320 can be configured to obtain the current draw measurement value of, for example, the second motor 204 and may periodically read (e.g., retrieve or receive) current draw measurement values from the current sensor 222. The current sensor interface 320 may be configured to then send the current draw measurement value to the comparator 308. Additionally or alternatively, the current sensor interface 320 may be configured to send the current draw measurement values to the first and/or second controller interfaces 328 and 330. Additionally or alternatively, the current sensor interface 320 may be configured to send the current draw values to the torque adjustor 318.

The first and/or second controller interfaces 328 and 330 and/or torque adjustor 318 may adjust (e.g., increase or decrease) the torque output values of the first and/or second motors 203 and 204 based on the comparison results obtained from the comparator 308. For example, if the comparison results obtained by the comparator 308 indicate that the second motor 204 is providing an output torque that is insufficient to drive a load (e.g., a plunge force) required to condition the strip material 100 based on the current draw measurement of the second motor 204, the torque adjustor 318 may increase the torque output of the second motor 204.

Additionally or alternatively, to protect the second motor 204 from being overworked or overloaded, the first and/or second controller interfaces 328 and 330 and/or torque adjustor 318 may adjust (e.g., decrease) the torque output values of the first and/or second motors 203 and 204 if the results obtained by the comparator 308 indicate that the second motor 204 is providing an output torque that is greater than a desired output torque based on the current draw measurement value of the second motor 204 provided by the current sensor interface 320. For example, the torque adjustor 318 may decrease the output torque of the first and/or the second motors 203 and 204 until the measured current draw value of the second motor 204 is within a desired range. For example, the comparator 308 may receive current draw measurement values of the second motor 204 from the current sensor interface 320 and compare the current draw measurement values to a full-load current rating of the second motor 204 to determine if the current draw of the second motor 204 is within a desired range (e.g., within a range of 5%) of the full-load current rating of the second motor 204.

Additionally or alternatively, the first speed sensor interface 322 may be communicatively coupled to an encoder or speed measurement device such as, for example, the encoder 215 of FIG. 2. The first speed sensor interface 322 can be configured to obtain speed values of the first motor 203 by, for example, reading the speed measurement values from the encoder 215. The first speed sensor interface 322 may be configured to send the speed values to the comparator 308. The comparator 308 may be configured to compare the speed values obtained from the first speed sensor interface 322 and the speed values obtained from the second speed sensor interface 324 and communicate the results of the comparisons to the speed adjustor 326.

The second speed sensor interface 324 may be communicatively coupled to an encoder or speed measurement device such as, for example, the encoder 216 of FIG. 2. The second speed sensor interface 324 can be configured to obtain speed values of the second motor 204 by, for example, reading measurement values from the encoder 216. The second speed sensor interface 324 may be configured to send the speed values to the comparator 308. Additionally or alternatively, the second speed sensor interface 324 may be configured to send the speed values to the first and/or second controller interfaces 328 and 330.

The speed adjustor 326 may be configured to adjust the speed of the first motor 203 so that the first motor 203 operates at a relatively slower speed than the second motor 204 (e.g., a predetermined speed value or percentage). For example, the comparison results obtained from the comparator 308 may indicate that a ratio between the speed measurement value measured by the second speed sensor interface 324 and the speed measurement value measured by the first speed sensor interface 322 is less than or greater than a predetermined speed ratio value. The speed adjustor 326 can then adjust the speed of the first motor 203 based on the comparison results obtained from the comparator 308 until a ratio between the speed measurement value measured by the second speed sensor interface 324 and the speed measurement value measured by the first speed sensor interface 322 is substantially equal to the predetermined speed ratio value (e.g., a first motor 203 to second motor 204 ratio of about 3 percent).

Additionally or alternatively, the speed adjustor 326 may be configured to adjust the speed of the first motor 203 so that the first motor 203 operates at a substantially equal speed of the second motor 204 if the comparator 308 determines that the torque mismatch between the first and second motors 203 and 204 is causing the second motor 204 to operate outside of a predetermined range of the full-load current rating of the second motor 204.

Figures 6, 8:
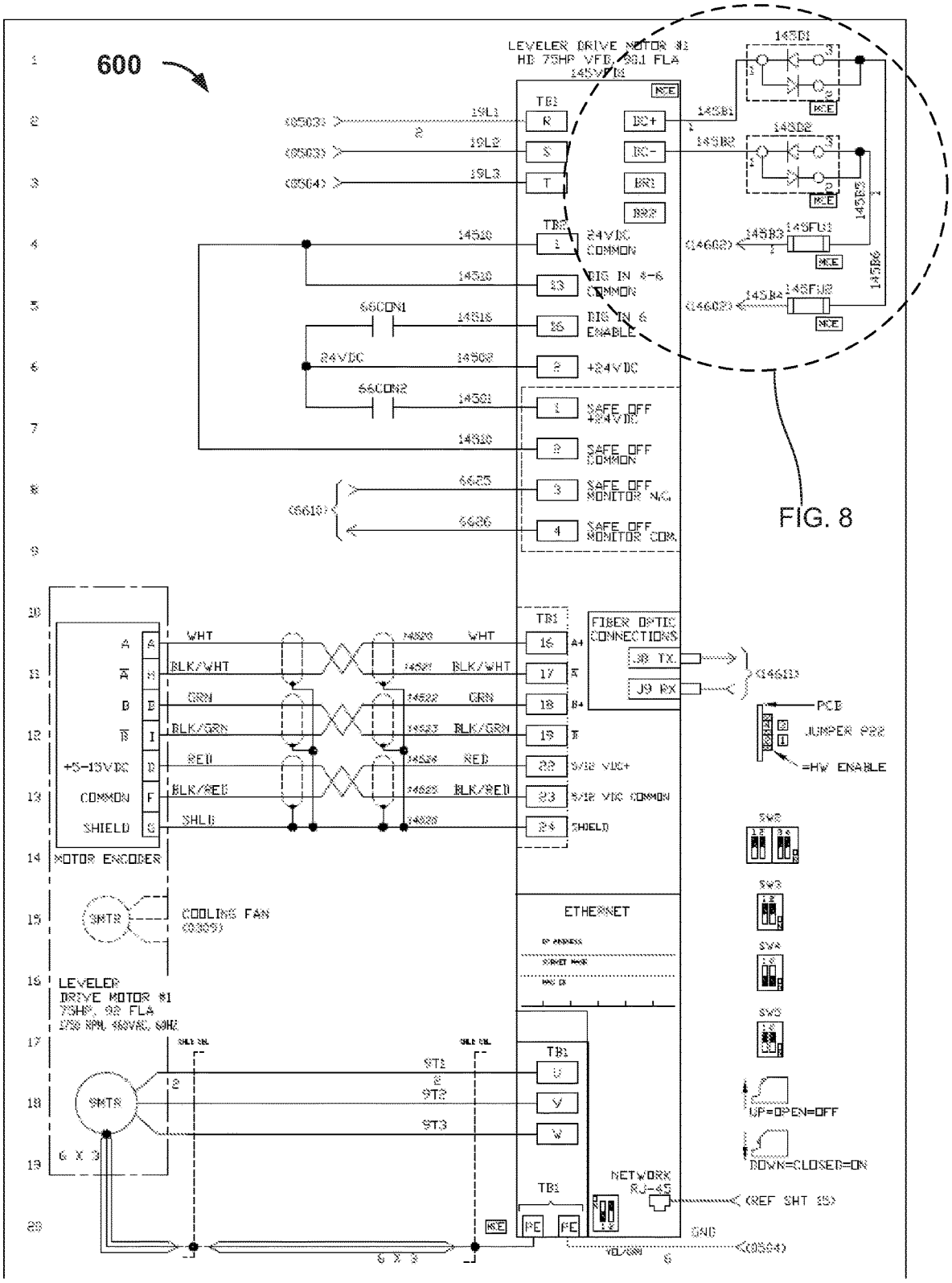
FIG. 6 is an electrical schematic depicting a first drive system that may be used to implement the example dual or split drive leveler of FIGS. 1A and 2.
FIG. 8 is an enlarged portion of the electrical schematic of FIG. 6.

The example apparatus 300 is also be provided with the current regeneration module interface 332 that may be implemented via, for example, the example circuit 800 of FIG. 8. The current regeneration module interface 332 provides circuitry to transfer the energy regenerated by the first motor 203 to the second motor 204.

Although the example apparatus 300 is shown as having only one comparator 308, in other example implementations, a plurality of comparators may be used to implement the example apparatus 300. For example, a first comparator can receive the speed measurement values from the first speed sensor interface 322 and the speed measurement values from the second speed sensor interface 324. A second comparator can receive the torque measurement values from the first torque sensor interface 314 and compare the values to the torque measurement values received from the second torque sensor interface 316.

Figure 4A:
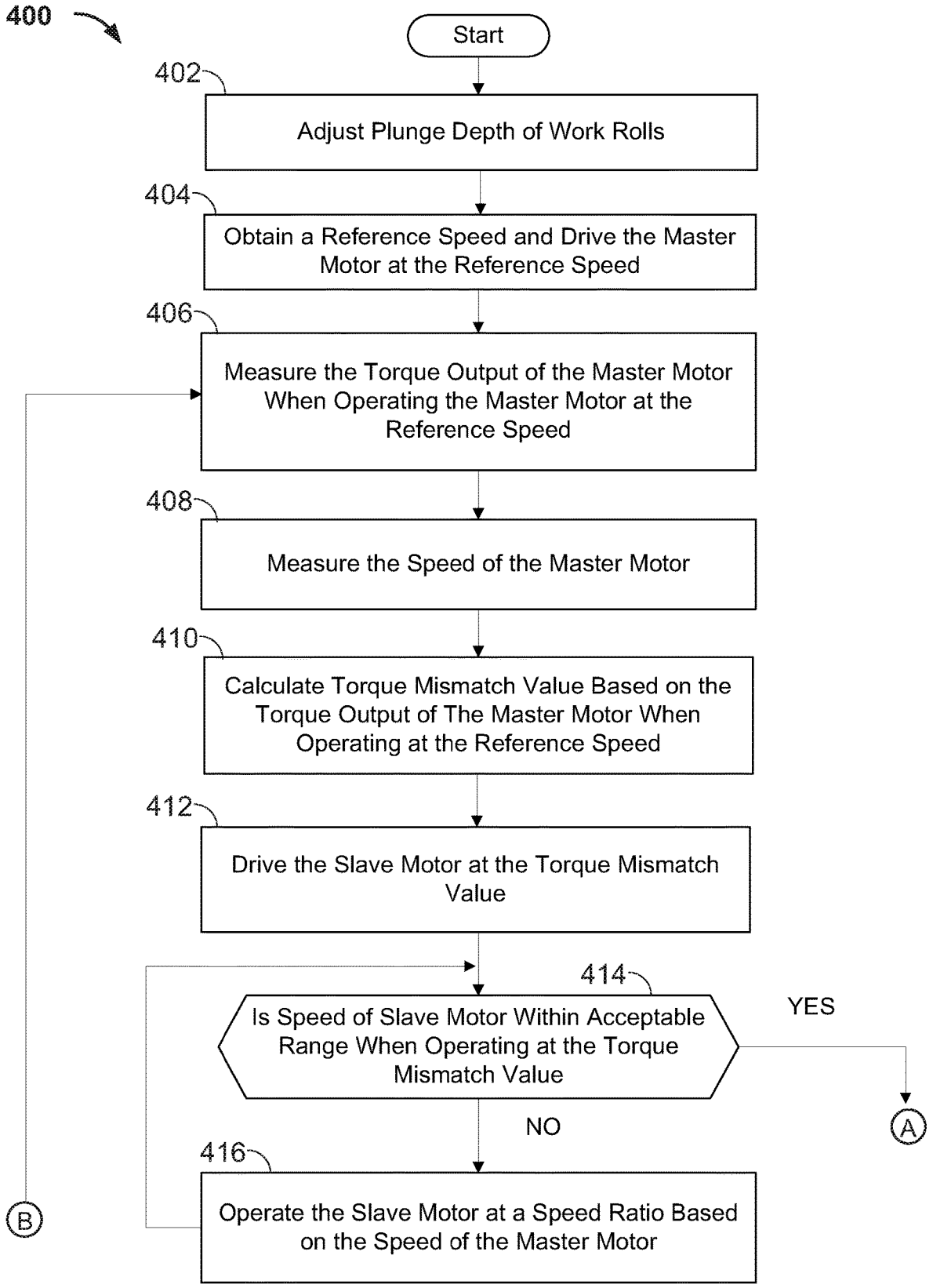
FIGS. 4A and 4B depict a flow diagram of an example method that may be implemented to control the example dual or split drive leveler of FIGS. 1A, 1B and 2.
Figure 4B:
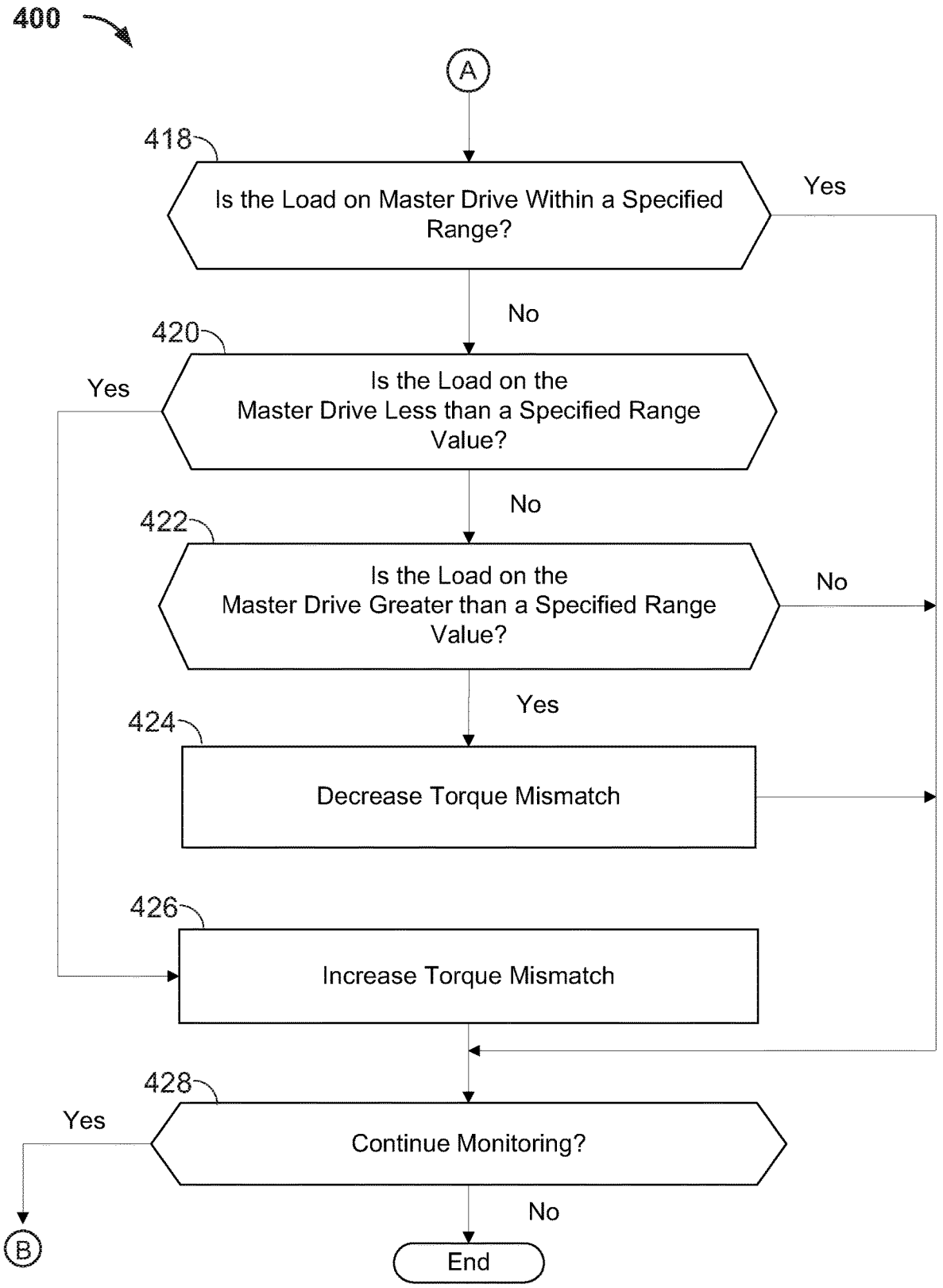

FIGS. 4A and 4B illustrate a flow diagram of an example method that may be used to implement the split drive leveler 102 of FIG. 1A. In some example implementations, the example method of FIGS. 4A and 4B may be implemented using machine readable instructions comprising a program for execution by a processor (e.g., the processor 512 of the example system 510 of FIG. 5). For example, the machine readable instructions may be executed by the control system 218 (FIG. 6) to control the operation of the example drive system 200. The program may be embodied in software stored on a tangible medium such as a CD-ROM, a floppy disk, a hard drive, a digital versatile disk (DVD), or a memory associated with the processor 512 and/or embodied in firmware and/or dedicated hardware. Although the example program is described with reference to the flow diagram illustrated in FIGS. 4A and 4B, persons of ordinary skill in the art will readily appreciate that many other methods of implementing the example split drive lever 102 may alternatively be used. For example, the order of execution of the blocks may be changed, and/or some of the blocks described may be changed, eliminated, or combined.

For purposes of discussion, the example method of FIGS. 4A and 4B is described in connection with the example apparatus 300 of FIG. 3. In this manner, each of the example operations of the example method of FIGS. 4A and 4B is an example manner of implementing a corresponding one or more operations performed by one or more of the blocks of the example apparatus 300 of FIG. 3.

Turning in detail to FIGS. 4A and 4B, initially, the user input interface 302 receives material characteristics information to adjust the plunge depth of the work rolls 108 (block 402). The material characteristics can include, for example, the thickness of the material, the type of material, etc. The plunge position adjustor 304 determines the plunge depth of the entry work rolls 114 and the exit work rolls 116 required to process the strip material 100 based on the material characteristics received at block 402. For example, the plunge position adjustor 304 can retrieve plunge depth values from a look-up table or other data structure having start-up plunge depth settings for different material types based on, for example, material yield strengths. In other example implementations, an operator or other user can manually set the initial plunge depth of the entry work rolls 114 and exit work rolls 116. The strip material 100 may be continuously fed to the leveler 102 from an uncoiler (e.g., the uncoiler 103 of FIG. 1A). During the leveling operation, subsequent operations (e.g., a roll-forming operation) may be performed as the strip material 100 continuously moves through the leveler 102.

After the plunge position adjustor 304 adjusts of the plunge of the work rolls 114 and 116, the reference speed is obtained, retrieved or determined by the reference speed detector 312. For example, the reference speed detector 312 measures the speed value of the strip material 100 moving through the leveler 102 and sends the reference speed measurement value to the second controller interface 330 (block 404). Additionally or alternatively, the reference speed may be provided via the user interface 302. The second controller 220 may then command the second motor 204 (e.g., the master drive or motor) to operate at the reference speed value (block 404).

The second torque sensor interface 316 measures a torque corresponding to the second motor 204 (e.g., the master drive or motor) via, for example, the torque sensor 214 (FIG. 2) when the second motor 204 is operating at the reference speed (block 406).

In addition, the second speed sensor interface 324 measures a speed value corresponding to the second motor 204 via, for example, the speed sensor 216 (FIG. 2) when the second motor 204 is operating at the reference speed value (block 408).

A torque mismatch value is determined based on the torque output of the second motor 204 (e.g., the master motor) when the second motor 204 is operating at the reference speed (block 410). For example, a mismatch output torque or ratio may be within a predetermined range of the torque output of the second motor 204 when the second motor 204 is operating at the reference speed. Thus, in some examples, the torque mismatch value may be three percent less than the torque output provided by the second motor at block 404.

The first controller 219 then commands the first motor 203 (e.g., the slave drive or motor) to generate an output torque substantially equal to the mismatch torque value (block 412). For example, the second torque sensor interface 316 sends the torque measurement value of the second motor 204 to the comparator 308. The comparator 308 then compares the torque measurement value of the first motor 203 to the torque mismatch ratio (e.g., a second torque to first torque ratio that is greater than one). The first controller 219 can receive the torque mismatch value and drives the first motor 203 (e.g., the slave motor) to generate the torque mismatch value.

In other words, the comparator 308 compares the torque measurement value of the first motor 203 to the torque measurement value of the second motor 204, and the torque adjustor 318 adjusts the first motor 203 to generate relatively less torque (e.g., a predetermined output torque value that is less than the output torque of the second motor 204) than the second motor 204 (block 412).

The first speed sensor interface 322 then measures a speed corresponding to the first motor 203 via, for example, the encoder 215 (FIG. 2). The comparator 308 can compare the speed measurement value of the first motor 203 to the speed measurement value of the second motor 204 to determine if the first motor 203 is within an acceptable speed range or limit when the first motor 203 is operating at the torque mismatch value (block 414). If the speed measurement value of the first motor 203 is outside of the speed limit range (e.g., a speed range value less than or greater than the speed measurement value of the second motor 204), the speed adjustor 326 can adjust the speed of the first motor 203 to operate at a speed that is substantially similar or equal to the speed measurement of the second motor 204 (block 416). The system 400 then returns to block 414 to determine whether the speed of the first motor 203 within an acceptable range of the second motor 204.

If the speed measurement value of the first motor 203 is within acceptable range or limit (block 414), the system 400 then determines if the load on the second motor is within a specific range when the first and second motors 203 and 204 are operating at the torque mismatch value (block 418). If the load on the second motor 204 is within the specific range, then the drive system continues to operate the first and second motors 203 and 204 at the mismatch torque value and determines whether to continue monitoring the first and second motors 203 and 204 (block 428).

To determine if the load on the second motor 204 is within a specific or predetermined range, the current sensor interface 320 measures the current draw of the second motor 204 when the first and second motors 203 and 204 are operating at the mismatch torque value. If the comparator 308 determines that the current draw measurement value of the second motor 204 provided by the current sensor 322 is within a predetermined range (e.g., a predetermined percentage) of the full-load current rating of the second motor 204, then the load on the second motor 204 is within a predetermined range. For example, the second motor 204 is operating within the predetermined range if the current draw of the second motor 204 is within 5% of the full-load current rating of the second motor 204.

If the load on the second drive is outside of the specific or predetermined range, then the controller determines if the load on the second motor 204 is less than the predetermined range (block 420). If the load on the second motor 204 is less than the predetermined range, the torque adjustor 318 increases the torque output of the second motor 204 and/or increases the torque mismatch ratio or value between the first and second motors 203 and 204 (block 426).

If the load on the second motor 204 is greater than the predetermined range, the torque adjustor 318 decreases the torque output of the second motor 204 and/or decreases the torque mismatch value between the first and second motors 203 and 204 (block 424).

The example method 400 then determines whether it should continue to monitor the torque mismatch process (block 428). For example, if the strip material 100 has exited the leveler 102 and no other strip material has been fed into the leveler 102, then the example method 400 may determine that it should no longer continue monitoring and the example method 400 is ended. Otherwise, control returns to block 402 and the example method 400 continues to monitor and/or adjust the mismatch torque values of the motors 203 and 204 and cause the second motor 204 to maintain a relatively higher output torque than the first motor 203 (e.g., a second output torque to first output torque ratio value greater than one).

As discussed above, driving the second motor 204 using relatively more torque than the first motor 203 causes the exit work rolls 116 to pull the strip material 100 through the split drive leveler 102 during the plunge process of the entry work rolls 114. In this manner, pulling the strip material 100 while it is stretched or elongated by the entry work rolls 114 facilitates further bending of the neutral axis of the strip material 100 toward the wrap angle of the work rolls 108 to cause substantially the entire thickness of the strip material 100 to exceed its yield point and enter a plastic phase resulting in greater deformation of the strip material 100. In this manner, the example methods and apparatus described herein can be used to produce a relatively flatter or more level strip material 100 by releasing substantially all of the residual stresses trapped in the strip material 100, or at least release relatively more residual stresses than many known techniques.

Further, as discussed above, driving the second motor 204 with relatively greater torque 204 than the first motor 203 during operation may cause the first motor 203 to provide a braking effect and act as a generator, thereby regenerating energy. The regenerated energy is fed back to the second motor 204 by the current regeneration module 332, thereby increasing the efficiency of the drive system 200. In some examples, the drive system 200 disclosed herein may be up to fifty percent more efficient that many known levelers.

FIG. 5 is a block diagram of an example processor system 510 that may be used to implement the example methods and apparatus described herein. As shown in FIG. 5, the processor system 510 includes a processor 512 that is coupled to an interconnection bus 514. The processor 512 includes a register set or register space 516, which is depicted in FIG. 5 as being entirely on-chip, but which could alternatively be located entirely or partially off-chip and directly coupled to the processor 512 via dedicated electrical connections and/or via the interconnection bus 514. The processor 512 may be any suitable processor, processing unit or microprocessor. Although not shown in FIG. 5, the system 510 may be a multi-processor system and, thus, may include one or more additional processors that are identical or similar to the processor 512 and that are communicatively coupled to the interconnection bus 514.

The processor 512 of FIG. 5 is coupled to a chipset 518, which includes a memory controller 520 and an input/output (I/O) controller 522. As is well known, a chipset typically provides I/O and memory management functions as well as a plurality of general purpose and/or special purpose registers, timers, etc. that are accessible or used by one or more processors coupled to the chipset 518. The memory controller 520 performs functions that enable the processor 512 (or processors if there are multiple processors) to access a system memory 524 and a mass storage memory 525.

The system memory 524 may include any desired type of volatile and/or non-volatile memory such as, for example, static random access memory (SRAM), dynamic random access memory (DRAM), flash memory, read-only memory (ROM), etc. The mass storage memory 525 may include any desired type of mass storage device including hard disk drives, optical drives, tape storage devices, etc.

The I/O controller 522 performs functions that enable the processor 512 to communicate with peripheral input/output (I/O) devices 526 and 528 and a network interface 530 via an I/O bus 532. The I/O devices 526 and 528 may be any desired type of I/O device such as, for example, a keyboard, a video display or monitor, a mouse, etc. The network interface 530 may be, for example, an Ethernet device, an asynchronous transfer mode (ATM) device, an 802.11 device, a DSL modem, a cable modem, a cellular modem, etc. that enables the processor system 510 to communicate with another processor system.

While the memory controller 520 and the I/O controller 522 are depicted in FIG. 5 as separate functional blocks within the chipset 518, the functions performed by these blocks may be integrated within a single semiconductor circuit or may be implemented using two or more separate integrated circuits.

Figure 7:
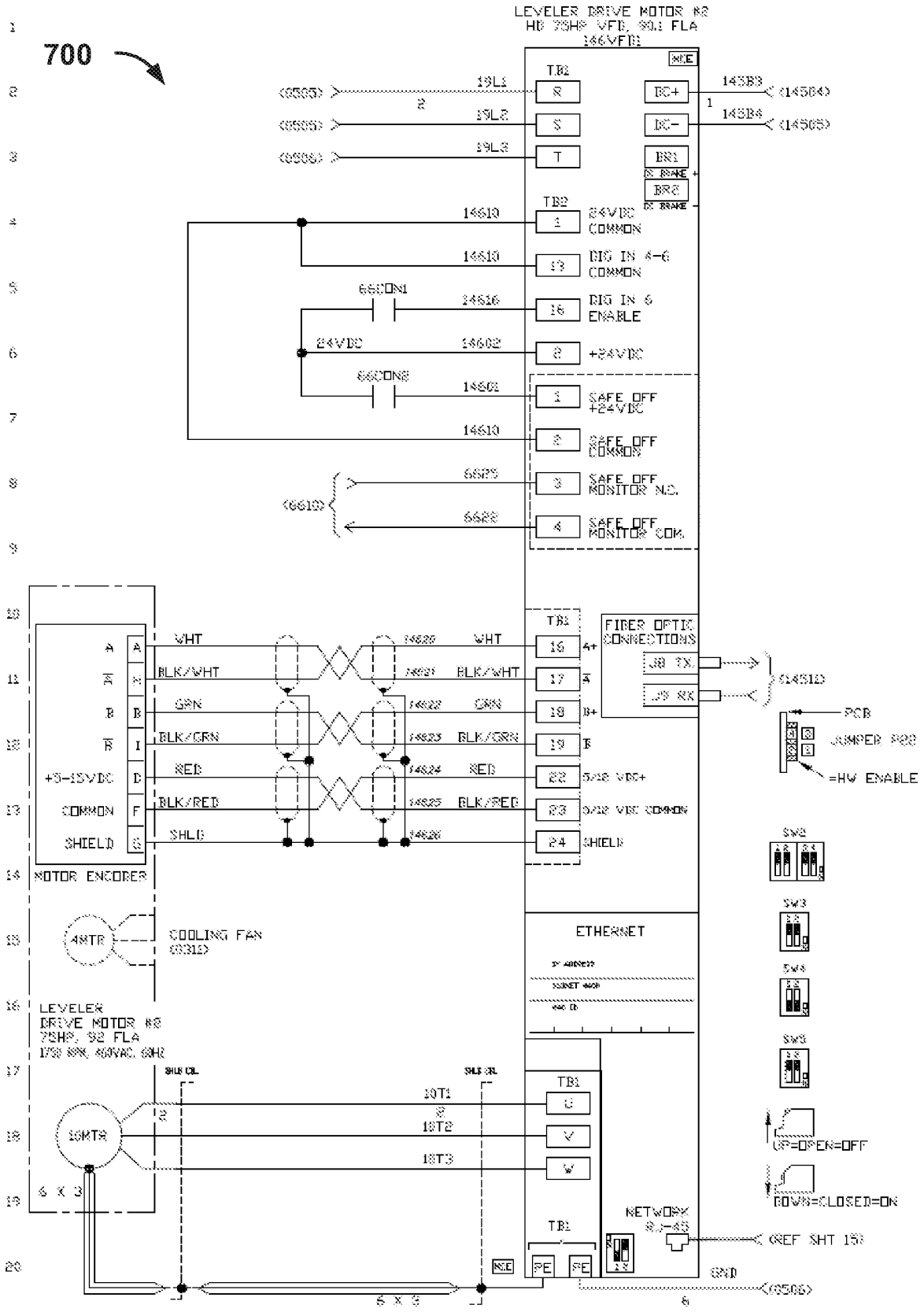
FIG. 7 is another electrical schematic depicting a second drive system that may be used to implement the example dual or split drive leveler of FIGS. 1A and 2.
Figure 8:
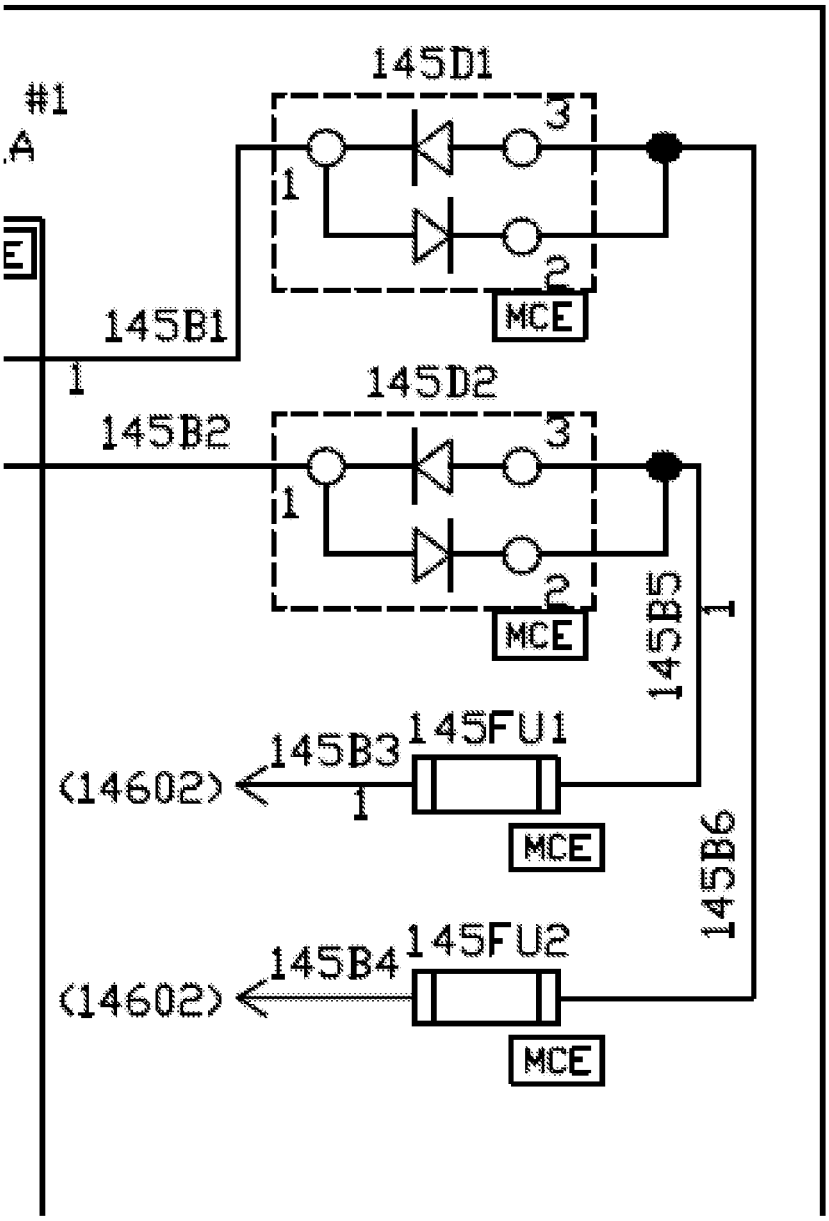

FIGS. 6 and 7 illustrate schematic diagrams 600 and 700 of a drive system that may be used to implement the drive system 200 of FIG. 2. In particular, the electrical diagram 600 of FIG. 6 illustrates an example drive system that may be used to implement the first drive system 201 of FIG. 2 and the electrical diagram 700 of FIG. 7 illustrates an example drive system that may be used to implement the second drive system 202 of FIG. 2.

FIG. 8 illustrates an enlarged portion of the example electrical schematic illustration of FIG. 6 showing an example electronic circuit 800 that may be used to implement the example current regeneration module 332 of FIG. 3 or 224 of FIG. 2.

Figure 9:
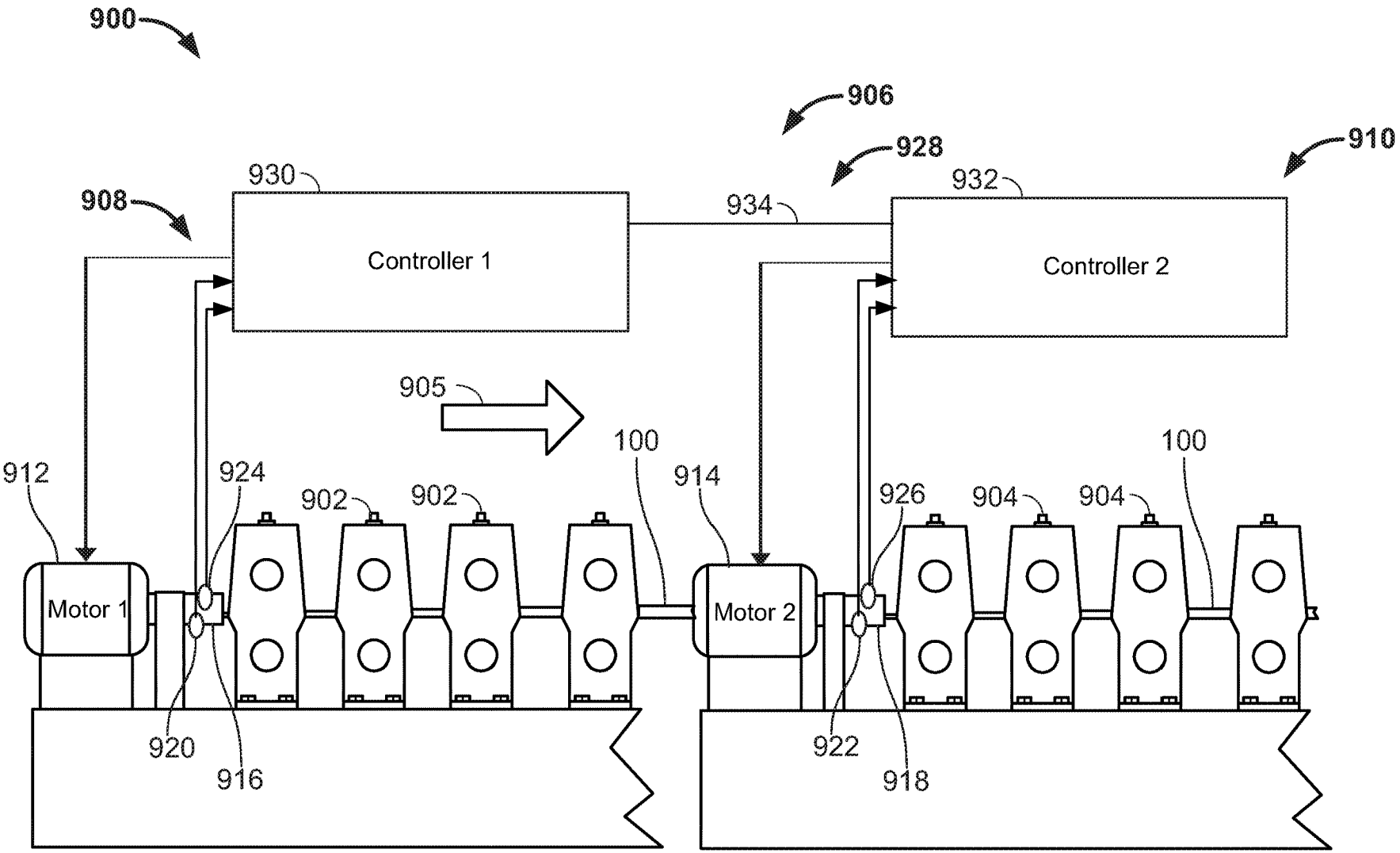
FIG. 9 is an example system that may be used to drive a roll-forming apparatus.

FIG. 9 is an example roll-forming system 900 that may be used to manufacture components from the strip material 100. The example roll-former system 900 may be part of, for example, a continuously moving material manufacturing system such as, for example, the system 10 of FIG. 1A. For example, the continuous material manufacturing system 10 may include the example roll-former system 900, which may be configured to form a component or perlin such as, for example, a metal beam or girder having any desired profile (e.g., a C-shaped component), a construction panel, structural beam, etc. In other examples, the example roll-forming system 900 may be a stand-alone system.

The example roll-forming system 900 includes a first plurality of roll formers 902 and a second plurality of roll formers 904, which sequentially exert bending forces upon the material 100 so as to deform the material and attain the desired profile of the component or perlin. The roll formers 902 and 904 cooperatively work to fold and/or bend the strip material 100 to form a component or perlin. Each of the roll formers 902 and 904 may include a plurality of forming work rolls (not shown) (e.g., supported by upper and lower arbors) that may be configured to apply bending forces to the strip material 100 at predetermined folding lines as the strip material 100 is driven, moved, and/or translated through the roll formers 902 and 904 in a direction 905. More specifically, as the material 100 moves through the example roll-former system 900, each of the roll formers 902 and 904 performs an incremental bending or forming operation on the material 100 to create a desired shape or configuration. A depth, gap or positional relationship of the work rolls may be adjusted to provide or create a desired shape or profile to the material 100 as the material 100 passes through the roll-forming system 900. For example, each of the work rolls representing a pass, increment bending or forming operation may be adjusted relative to another one of the work rolls based on the material characteristics such as, for example, thickness, bend, flare, hardness, etc. Adjusting the depth or positional relationship of the work rolls may affect the torque requirements of the drive system 906.

In this example, the roll-forming system 900 includes a multi-drive system 906 having a first drive system 908 to drive the roll formers 902 and a second drive system 910 to drive the roll formers 904. In this example, the first drive system 908 includes a first motor 912 (e.g., a master drive) to drive the roll formers 902 and the second drive system 910 includes a second motor 914 (e.g., a slave drive) to drive the roll formers 904. The first motor 912 and/or the second motor 914 may be implemented using any suitable type of motor such as, for example, an AC motor (e.g., a 3-phase induction motor), a variable frequency motor, a D.C. motor, a stepper motor, a servo motor, a hydraulic motor, etc. Although not shown, the roll-forming system 900 may include one or more additional motors. For example, the drive system 906 may include a third motor.

The first motor 912 and/or the second motor 914 may be operatively coupled to and configured to drive portions of the respective roll formers 902 and 904 via, for example, gears, pulleys, chains, belts, etc. In yet other examples, each work roll of the plurality of roll formers 902 and/or each work roll of the plurality of roll formers 904 may be independently driven by a dedicated drive system such as, for example, the drive systems 908 or 910. Thus, each work roll of the roll formers 902 and each work roll of the roll formers 904 may be independently driven by a separate motor, where each separate motor may be driven in direct relation or based on an output parameter of one or more of the other motors as described herein. Further, the drive system 906 may include a master drive and a plurality of slave drives.

An output shaft 916 of the first motor 912 is operatively coupled to the first plurality of roll formers 902 via, for example, a drive shaft, a gear transmission system, a gear box, etc. An output shaft 918 of the second motor 914 is operatively coupled to the first plurality of roll formers 904 via, for example, a drive shaft, a gear transmission system, a gear box, etc. In particular, the first motor 912 of the first drive system 908 is only mechanically coupled to the second motor 914 of the drive system 910 via the strip material 100 moving between the roll formers 902 and the roll formers 904.

In the illustrated example of FIG. 9, the roll-forming system 900 is provided with torque sensors 920 and 922 to monitor the output torques of the first motor 912 and the second motor 914, respectively. The torque sensor 920 can be positioned on or coupled to the shaft 916 of the first motor 912, and the torque sensor 922 can be positioned on or coupled to the shaft 918 of the second motor 914. The torque sensors 920 and 922 may be implemented using, for example, rotary strain gauges, torque transducers, encoders, rotary torque sensors, torque meters, etc. In other example implementations, other sensor devices may be used instead of torque sensors to monitor the torques of the first and second motors 920 and 922. In some example implementations, the torque sensors 920 and 922 can alternatively be positioned on shafts or spindles of the work rolls of the roll formers 902 and/or 904 to monitor the rolling torques of the work rolls of the roll formers 902 and/or 904. In some examples, the drive system 906 (e.g., via a controller) can receive a signal from the motor's drive (e.g., the motors 912 and 914) that correlates to the output torque value of each of the motors 912 and/or 914. Alternatively, drive system 201 and/or 202 (e.g., a controller) may receive a signal from directly from the motor's drive that corresponds to the output torques of the second motor 204 or the first motor 203.

In yet other example implementations, the roll-forming system 900 can be provided with encoders 924 and/or 926 to monitor the output speeds of the first motor 912 and/or the second motor 914. The encoders 924 and 926 can be engaged to and/or coupled to the shafts 916 and 918, respectively. Each of the encoders 924 and 926 may be implemented using, for example, an optical encoder, a magnetic encoder, etc. In yet other example implementations, other sensor devices may be used instead of an encoder to monitor the speeds of the motors 912 and 914 and/or the work rolls of the roll former 902 and/or 904.

In the illustrated example, the example drive system 906 includes a control system 928 to control the torque and/or speed of the first and second motors 912 and 914. In this example, the control system 218 includes a first controller 930 (e.g., a variable frequency drive) to control the torque and/or speed of the first motor 912 and a second controller 932 (e.g., a variable frequency drive) to control the torque and/or speed of the second motor 914. The first and second controllers 930 and 932 are communicatively coupled via a common bus 934.

As discussed in greater detail below, the first controller 930 monitors the output torque of the first motor 912 (e.g., the master motor) and commands the first motor 912 to operate at a reference speed value received by the first controller 930. The second controller 932 controls or commands the second motor 914 to produce a substantially similar output torque as the output torque of the first motor 912 when the first motor 912 is operating at the reference speed (i.e., torque matching). In other words, the torque outputs of the first and second motors 912 and 914 are controlled to provide substantially the same output torque values. As a result, the speed outputs of the first and second motors 912 and 914 may be different when the first and second motors 912 and 914 are generating substantially similar output torque values. In other words, the speed of the first motor 912 may be operating at a speed that is lower than the speed of the second motor 914 based on the load imparted on the first motor 912 when operating the first and second motors 930 and 932 at the matching torque value.

Additionally or alternatively, the control system 928 can control the output speeds of the first and second motors 912 and 914 such that both the first and the second motors 912 and 914 operate at substantially the same output speed (e.g., the reference speed value). For example, the control system 928 operates the first and second motors 912 and 914 at the same speeds as the reference speed when the speed output value of the second motor 914 (e.g., the slave drive) is outside of a predetermined speed range or value when the first and second motors 912 and 914 are operating at the torque matching value. For example, the second controller 932 can control the speed of the second motor 914 to operate at a speed that is substantially equal to the speed of the first motor 912.

In operation, as the material 100 moves through the first roll formers 902, the first motor 912 (or master drive) may require more torque to feed the material 100 until the material 100 is driven to the second roll formers 904. Once the material moves (e.g., continuously moves) to the second roll formers 904, the second controller 932 commands the second motor 914 to drive at the output torque of the first motor 912 when the first motor 912 is operating at the reference speed value. When the torque outputs of the first and second motors 912 and 914 are substantially equal, the torque matching causes the torque across the drive system 908 to be substantially evenly distributed among the drive systems 908 and 910. As a result, the power loss between the first and second drive systems 908 and 910 is substantially reduced or eliminated because the first motor 912 and/or the second motor 914 do not work against each other due to mechanical mismatches in the roll-forming system 900, thereby significantly reducing the overall power usage of the system 900.

In a conventional roll-forming apparatus or system, operating multiple drive systems or motors at similar or equal speeds may not account for mechanical mismatches or losses between the upstream and downstream roll formers. For example, setting or causing all the drives in a conventional roll-forming apparatus to operate at the same speed may cause the torque output of each of the drives in the system to adjust to meet the particular speed reference. As a result, a torque mismatch in a roll-forming system may cause one motor of the system to produce more work against another motor of the system from opposing sides of the mechanical mismatch. For example, a first motor downstream of a second motor may generate a greater output torque to maintain the speed of the downstream motor at the specified reference speed value. As the strip material 100 is being bent via the forming work rolls of the downstream roll former, a greater load may be imparted on the downstream motor to process the strip material 100 while maintaining the output speed at the set reference speed. An upstream motor may also increase its output torque to resist the downstream motor from pulling the strip material 100 through the upstream roll former with a higher torque or force.

Thus, unlike conventional roll-forming systems, the example roll-forming system 900 described herein uses a torque matching technique during operation. The torque matching technique significantly improves the efficiency of the drive system 906 by substantially reducing or accounting for mechanical losses due to mechanical mismatches between the first and second motors 912 and 914. For example, the first controller 930 may operate the first motor or master drive 912 at a reference speed and measure the torque output of the first motor 912 when the first motor 912 is operating at the reference speed. The second controller 932 may operate the second motor or the slave drive 914 at the measured output torque of the first motor 912 when the first motor 912 is operating at the reference speed. During operation and when the strip material 100 is passing through the roll formers 902 and 904, both the first motor 912 and the second motor 914 operate at substantially the same torque values. As a result, the torque outputs of the first and second motors 912 and 914 are substantially evenly distributed among all the drives 908 and 910. The overall power usage of the first and second motors 912 and 914 is reduced because there are no losses of power from the drives 908 and 910 working against each other across mechanical mismatches. Thus, the roll-forming system 900 provides a more efficient drive system 906 compared to a drive system of a conventional roll-forming system.

Figure 10:
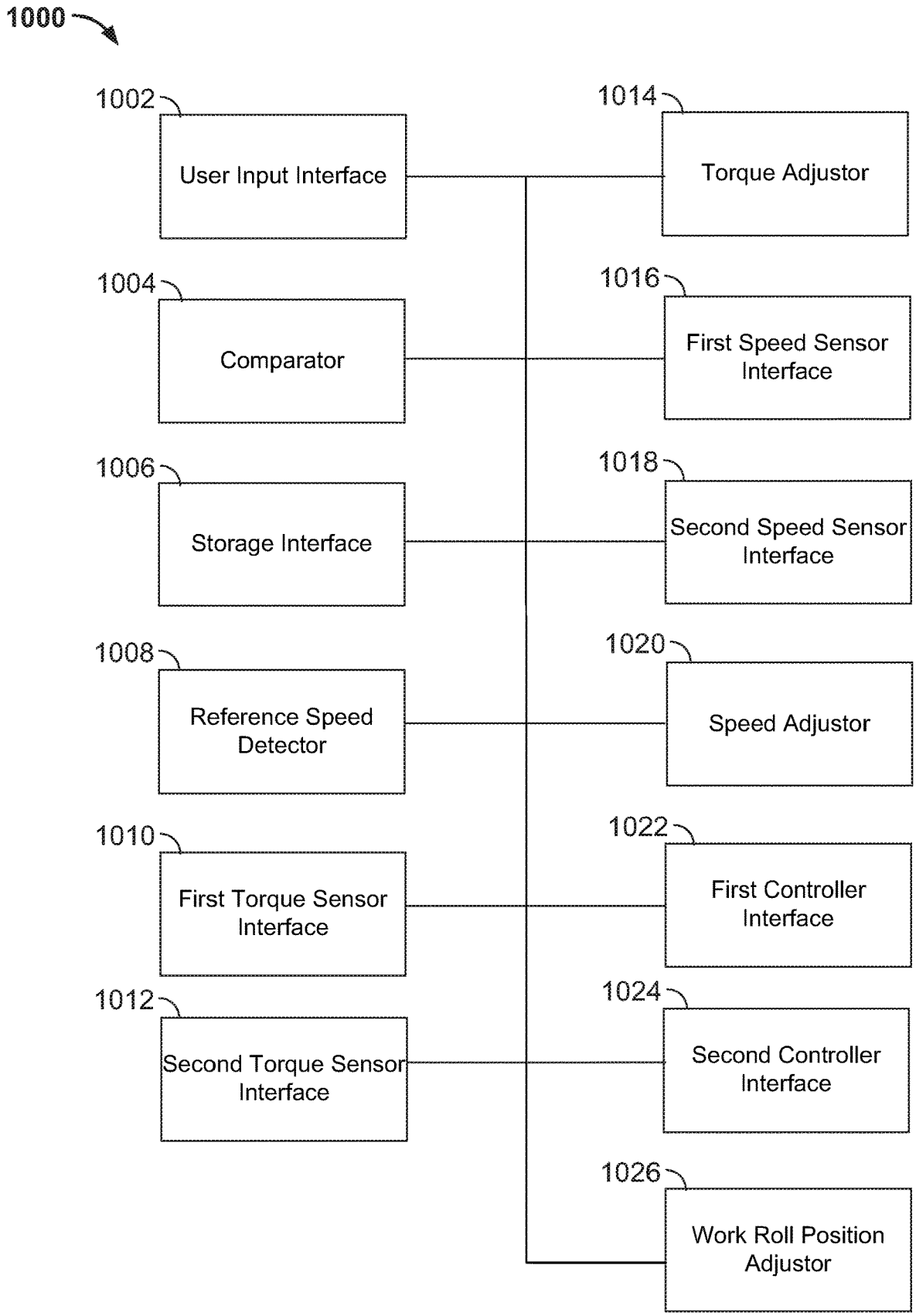
FIG. 10 is a block diagram of an example apparatus that may be used to implement the example methods described herein.

FIG. 10 is a block diagram of an example apparatus 1000 that may be used to implement the example methods described herein. In particular, the example apparatus 1000 may be used in connection with and/or may be used to implement the example system 900 of FIG. 9 or portions thereof to match a torque output between the first and second motors 912 and 914 so that the second motor 914 can generate a torque output that is substantially equal to the torque output of the first motor 912. Alternatively, as described in greater detail below, the example apparatus 1000 may be used to implement an example leveler such as, for example, the leveler apparatus 102 of FIGS. 1A and 1B. The example apparatus 1000 may also be used to implement a feedback system to adjust the speed ratio of the first and second motors 912 and 914. For example, the feedback system may cause the first and second motors 912 and 914 to operate at a substantially similar speed (speed matching) if the speed of the second motor 914 is not within a predetermined speed range when the first motor 912 is operating at the torque output based on the reference speed input. For example, the feedback system ensures that the second motor 914 does not operate above a specific operating speed range (e.g. within 5% of the reference speed) of the first motor 912 during operation. For example, if the torque matching ratio between the first and second motors 912 and 914 causes the second motor 914 to operate outside a desired or predetermined speed range, then the speeds of the first and second motors 203 and 204 are controlled to be substantially the same (e.g., the speed of the reference speed).

The example apparatus 1000 may be implemented using any desired combination of hardware, firmware, and/or software. For example, one or more integrated circuits, discrete semiconductor components, and/or passive electronic components may be used. Additionally or alternatively, some or all of the blocks of the example apparatus 1000, or parts thereof, may be implemented using instructions, code, and/or other software and/or firmware, etc. stored on a machine accessible medium that, when executed by, for example, a processor system (e.g., the processor system 510 of FIG. 5) perform the operations represented in the flowchart of FIG. 11. Although the example apparatus 1000 is described as having one of each block described below, the example apparatus 1000 may be provided with two or more of any block described below. In addition, some blocks may be disabled, omitted, or combined with other blocks.

As shown in FIG. 10, the example apparatus 1000 includes a user input interface 1002, a comparator 1004, a storage interface 1006, a reference speed detector 1008, a first torque sensor interface 1010, a second torque sensor interface 1012, a torque adjustor 1014, a first speed sensor interface 1016, a second speed sensor interface 1018, a speed adjustor 1020, a first controller interface 1022, and a second controller interface 1024, all of which may be communicatively coupled as shown or in any other suitable manner.

The user input interface 1002 may be configured to determine the formed component characteristics or parameters. For example, the formed components are typically manufactured to comply with tolerance values associated with bend angles, lengths of material, distances from one bend to another to form a specific profile (e.g., an L-shaped profile, a C-shaped profile, etc.). For example, the user input interface 1002 may be implemented using a mechanical and/or electronic graphical user interface via which an operator can input the characteristics. The system 1000 may also include work roll position adjustor 1026 to adjust the angle and/or position of the forming work rolls of the roll formers 902 and/or the roll formers 904 based on the characteristics received by the user input interface 1002.

The storage interface 1006 may be configured to store data values in a memory such as, for example, the system memory 524 and/or the mass storage memory 525 of FIG. 5. Additionally, the storage interface 1006 may be configured to retrieve data values from the memory (e.g., from the data structure). For example, the storage interface 1006 may access the data structure to obtain forming roll position values from the memory and communicate the values to the work roll position adjustor 1026.

The reference speed detector 1008 may be communicatively coupled to an encoder or speed measurement device that measures a reference speed value. For example, the reference speed detector 1008 may obtain, retrieve or measure a reference speed based on the speed of the strip material 100 traveling through the roll-forming system 900 (e.g., a line speed of the material). Additionally or alternatively, the reference speed detector 1008 may receive a reference speed from the user interface 1002. Additionally or alternatively, the reference speed detector 1008 may be configured to send the reference speed measurement value to the comparator 1004. Additionally or alternatively, the reference speed detector 1008 may then send the reference speed value to the first controller interface 1022, which may then command the first motor 912 to operate at the reference speed measurement value provided by the reference speed detector 1008. Additionally or alternatively, the reference speed detector 1008 may then send the reference speed value to the second controller interface 1024, which may then command the second motor 914 to operate at the reference speed measurement value provided by the reference speed detector 1008.

The first torque sensor interface 1010 may be communicatively coupled to a torque sensor or torque measurement device such as, for example, the torque sensor 920 of FIG. 9. The first torque sensor interface 1010 can be configured to obtain the torque value of, for example, the first motor or master drive 912 and may periodically read (e.g., retrieve or receive) torque measurement values from the torque sensor 920. The first torque sensor interface 1010 may be configured to then send the torque measurement value to the comparator 1004. Additionally or alternatively, the second torque sensor interface 1012 may be configured to send the torque measurement values to the first and/or second controller interfaces 1022 and 1024.

The second torque sensor interface 1012 may be communicatively coupled to a torque sensor or torque measurement device such as, for example, the second torque sensor 922 of FIG. 9. The second torque sensor interface 1012 can be configured to obtain the torque value of, for example, the second motor 914 and may periodically read torque measurement values from the torque sensor 922. For example, the second torque sensor interface 1012 may be configured to then send the torque measurement values to the comparator 1004. Additionally or alternatively, the second torque sensor interface 1012 may be configured to send the torque measurement values to the first and/or second controller interfaces 1022 and 1024.

The comparator 1004 may be configured to perform comparisons based on the torque values received from the first torque sensor interface 1010 and the second torque sensor interface 1012 to determine if the second motor 914 is operating within a torque matching value. In other words, the comparator 1004 performs comparisons to determine if the second motor 914 is generating a substantially similar output torque as the output torque of the first motor 912 when the first motor 912 is operating at the reference speed provided by the reference speed detector 1008. For example, the comparator 1004 may be configured to compare the torque values measured by the first torque sensor interface 1010 with the torque values measured by the second torque sensor interface 1012 to determine if the first motor 912 is generating a first motor torque output to a second motor torque output ratio that is substantially one to one. The comparator 1004 may then communicate the results of the comparisons to the torque adjustor 1014.

The first and/or second controller interfaces 1022 and 1024 and/or the torque adjustor 1014 may be configured to adjust (e.g., increase or decrease) the torque of the second motor 914 (e.g., the slave motor) based on the comparison results obtained from the comparator 1004. For example, if the comparison results obtained from the comparator 1004 indicate that a torque ratio of the torque measurement value of the second torque sensor interface 1012 and the torque measurement value measured by the first torque sensor interface 1010 is less than or greater than a predetermined torque ratio value (e.g., a torque matching ratio of substantially 1:1), the torque adjustor 1014 can adjust (e.g., increase or decrease) the torque of the second motor 914 until a torque ratio between the torque measurement value measured by the first torque sensor interface 1010 and the torque measurement value measured by the second torque sensor interface 1012 is within the predetermined torque ratio value or range (a torque ratio of 1:1).

Additionally or alternatively, the first speed sensor interface 1016 may be communicatively coupled to an encoder or speed measurement device such as, for example, the encoder 924 of FIG. 9. The first speed sensor interface 1016 can be configured to obtain speed values of the first motor 912 by, for example, reading the speed measurement values from the encoder 924. The first speed sensor interface 1016 may be configured to send the speed values to the comparator 1004. The comparator 1004 may be configured to compare the speed values obtained from the first speed sensor interface 1016 and the speed values obtained from the second speed sensor interface 1018 and communicate the comparison results of the comparisons to the speed adjustor 1020.

The second speed sensor interface 1018 may be communicatively coupled to an encoder or speed measurement device such as, for example, the encoder 926 of FIG. 9. The second speed sensor interface 1018 can be configured to obtain speed values of the second motor 914 by, for example, reading measurement values from the encoder 926. The second speed sensor interface 1018 may be configured to send the speed values to the comparator 1004. Additionally or alternatively, the second speed sensor interface 1018 may be configured to send the speed values to the first and/or second controller interfaces 1022 and 1024.

The speed adjustor 1020 may be configured to adjust the speed of the first motor 912 and/or the speed of the second motor 914 so that the first motor 912 and the second motor 914 operate at about the same or identical speed (e.g., the reference speed value) when the speed of the second motor 914 (e.g., the slave drive) is outside of a predetermined range when the first motor 912 (e.g., the master drive) is operating at the reference speed. For example, if the comparison results obtained from the comparator 1008 indicate that a ratio between the speed measurement value measured by the second speed sensor interface 1018 and the speed measurement value measured by the first speed sensor interface 1020 is less than or greater than a predetermined speed ratio value (e.g., a predetermined ratio value less than or greater than the speed of the master drive or first motor 912), the speed adjustor 1020 can adjust the speed of the second motor 914 (e.g., the slave drive) based on the comparison results obtained from the comparator 1004 until a ratio between the speed measurement value measured by the second speed sensor interface 1018 and the speed measurement value measured by the first speed sensor interface 1020 is substantially equal to the reference speed.

Additionally or alternatively, the speed adjustor 1020 may be configured to adjust the speed of the first motor 912 so that the first motor 912 operates at a speed substantially equal to the speed of the second motor 914 if the comparator 10048 determines that the torque matching between the first and second motors 912 and 914 is causing the second motor 914 to operate outside of a predetermined speed range. For example, if the comparator 1004 determines that the speed measurement value measured by the second speed sensor interface 1018 is greater or lower than the speed measurement value measured by the first speed interface 1016 by a factor of, for example, between 1 percent and 5 percent greater than or less than the speed of the first motor 912, the second controller 932 may command the second motor 914 to operate at the reference speed of the first motor 912 provided by the first speed sensor interface 1016.

Although the example apparatus 1000 is shown as having only one comparator 1004, in other example implementations, a plurality of comparators may be used to implement the example apparatus 1000. For example, a first comparator can receive the speed measurement values from the first speed sensor interface 1016 and the speed measurement values from the second speed sensor interface 1018. A second comparator can receive the torque measurement values from the first torque sensor interface 1010 and compare the values to the torque measurement values received from the second torque sensor interface 1012.

Figure 11:
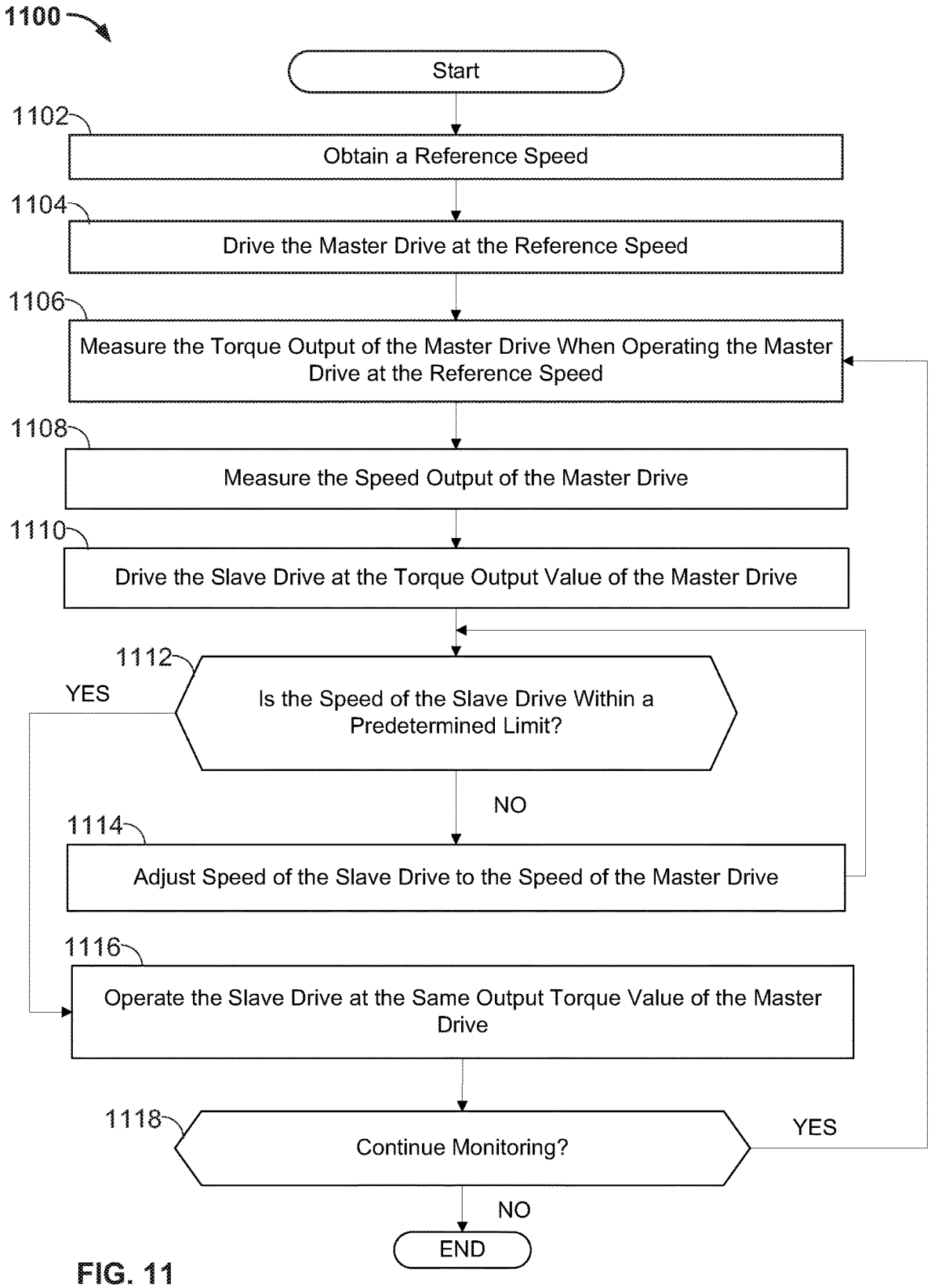
FIG. 11 is a flow diagram of an example method that may be implemented to control the example split drive leveler of FIGS. 1A, 1B and 2 or the roll-forming apparatus of FIG. 9.

FIG. 11 illustrates a flow diagram 1100 of an example method that may be used to implement the roll-forming system 900 of FIG. 9. In some example implementations, the example method of FIG. 11 may be implemented using machine readable instructions comprising a program for execution by a processor (e.g., the processor 512 of the example system 510 of FIG. 5). For example, the machine readable instructions may be executed by the control system 918 (FIG. 9) to control the operation of the example drive system 906. The program may be embodied in software stored on a tangible medium such as a CD-ROM, a floppy disk, a hard drive, a digital versatile disk (DVD), or a memory associated with the processor 512 and/or embodied in firmware and/or dedicated hardware. Although the example program is described with reference to the flow diagram illustrated in FIG. 11, persons of ordinary skill in the art will readily appreciate that many other methods of implementing the example roll-forming system 900 may alternatively be used. For example, the order of execution of the blocks may be changed, and/or some of the blocks described may be changed, eliminated, or combined.

For purposes of discussion, the example method of FIG. 11 is described in connection with the example apparatus 1000 of FIG. 10. In this manner, each of the example operations of the example method of FIG. 11 is an example manner of implementing a corresponding one or more operations performed by one or more of the blocks of the example apparatus 1000 of FIG. 10.

Turning in detail to FIG. 11, the method 1100 obtains a reference speed value (block 1102). For example, the reference speed interface 1008 measures, obtains or retrieves the speed value of the strip material 100 moving through the roll-forming system 900 and sends the reference speed measurement value to the first controller interface 1022. Additionally or alternatively, the reference speed may be provided to the first controller interface 1022 via the user interface 1002.

The first controller 220 may command the first motor or master drive 912 to operate at the reference speed value (block 1104). When the first motor 912 is operating at the reference speed value, the torque output of the first motor 912 is measured (block 1106). For example, the torque output of the first motor 912 may be measured by the torque sensor 920. The first torque sensor interface 1010 may receive this torque measurement value and communicate or send the torque measurement value to the second controller interface 1024 and/or the first controller interface 1022.

When the first motor 912 (e.g., the master drive) is operating at the reference speed, the speed sensor 924 measures the speed output of the first motor 912 and communicates this speed output value to the first speed sensor interface 1016 (block 1108). The first speed sensor interface 1016 may store this value via the storage interface 1006, and/or send it to the comparator 1004, the first controller interface 1022 and/or the second controller interface 1024.

The second controller 932 then commands the second motor or slave drive 914 to generate an output torque substantially equal to the torque value of the first motor 912 (block 1110). In other words, the method 1100 provides a torque matching value so that the second motor or slave drive 914 operates at substantially similar torque output as the first motor or master drive 912. For example, the first torque interface 1010 sends the torque measurement value of the first motor 912 (e.g., the master drive) to the comparator 1004 and the second torque interface 1012 sends the torque measurement value of the second motor 914 (e.g., the slave drive) to the comparator 1004. The comparator 1004 compares the torque measurement value of the first motor 912 to the torque measurement value of the second motor 914 and sends a signal to the first and/or second controller interfaces 1022 and 1024 and/or the torque adjustor 1014 to adjust the output torque of the second motor 914 until the comparator 1004 determines that the second motor 914 is generating the same torque output as the first motor 912 (block 1110).

Additionally or alternatively, the first speed sensor interface 1016 can measure a speed corresponding to the second motor 914 (e.g., the master drive) via, for example, the encoder 926 (FIG. 9). The comparator 1004 can compare the speed measurement value of the second motor 914 (e.g., the slave drive) to the speed measurement value of the first motor 912 to determine if the speed of the second motor 914 is within an acceptable speed range or limit of the speed of the first motor 912 when the first motor and second motors 912 and 914 are operating at the torque matching value (block 1112).

If the speed measurement value of the second motor 203 is outside of the speed limit range (e.g., a predetermined range greater than or less than the speed measurement value of the first motor or master drive 912), then speed adjustor 1020 can adjust the speed of the second motor 914 to operate at a substantially similar or equal speed as the speed measurement value of the first motor 912 (block 1114). The method 1100 then returns to block 1112 to determine whether the speed of the second motor 914 is within an acceptable range of the speed of the first motor 912.

If the speed measurement value of the second motor 912 is within the acceptable range or limit (block 1112), the method 1100 then continues to operate the first and second motors 912 and 914 at the torque matching value (block 1116).

The method 1100 then determines whether to continue monitoring the first and second motors 912 and 914 (block 1118). For example, if the strip material 100 has exited the roll-forming system 900 and no other strip material 100 has been fed into the roll-forming system 900, then the example method 1100 may determine that it should no longer continue monitoring and the example process is ended. Otherwise, control returns to block 1106 and the example method 1100 continues to monitor and/or operate the torque matching values of the motors 912 and 914 and cause the second motor 914 to maintain a relatively similar output torque compared to the first motor 912.

Alternatively, the example apparatus 1000 of FIG. 10 and the example method 1100 of FIG. 11 may be used to implement an example leveler apparatus such as, for example, the leveler 102 of FIGS. 1A and 1B. For example, the leveler 102 may be configured to provide a torque matching application based on the example apparatus 1000 and the example method 1100 of FIGS. 10 and 11 instead of the torque mismatching application provided by the example apparatus 300 of FIG. 3 and the example method 400 of FIG. 4. In other words, the first motor 203 of the example leveler 102 may be configured to provide an output torque that is substantially similar to an output torque provided by the second motor 204.

For example, the controller 220 may obtain a reference speed value (block 1102) and drive the second motor 204 the reference speed after the plunge depth of the work rolls 114 and 116 has been set or adjusted (block 1104). The torque sensor 214 may measure the output torque of the second motor 204 when the second motor 204 operates at the reference speed (block 1106). The speed sensor 216 may measure the speed output of the second motor 204 (block 1108). The controller 219 may then receive a command reference or torque output of the second motor 204. The controller 219 commands or drives the first motor 203 (e.g., the slave drive) at the torque output value of the second motor 204 (block 1110). If the speed of the first motor 203 provided or measured by the speed sensor 215 is within a predetermined limit (block 1112), then the controller 219 continues to drive or operate the first motor 203 at the same output torque value of the second motor 204 (block 1116). If the speed of the first motor 203 is not within the predetermined limit at block 1112, then the controller 219 adjusts the speed of the first motor 203 to the speed of the second motor 204 and the system 400 returns to block 1112 (block 1114).

Operating or driving the first and second motors 203 and 204 at substantially the same torque significantly increases the efficiency of the leveler 102 when compared to conventional levelers having only one motor or multi-motors that are independently driven at the same speed reference.

Figure 12:
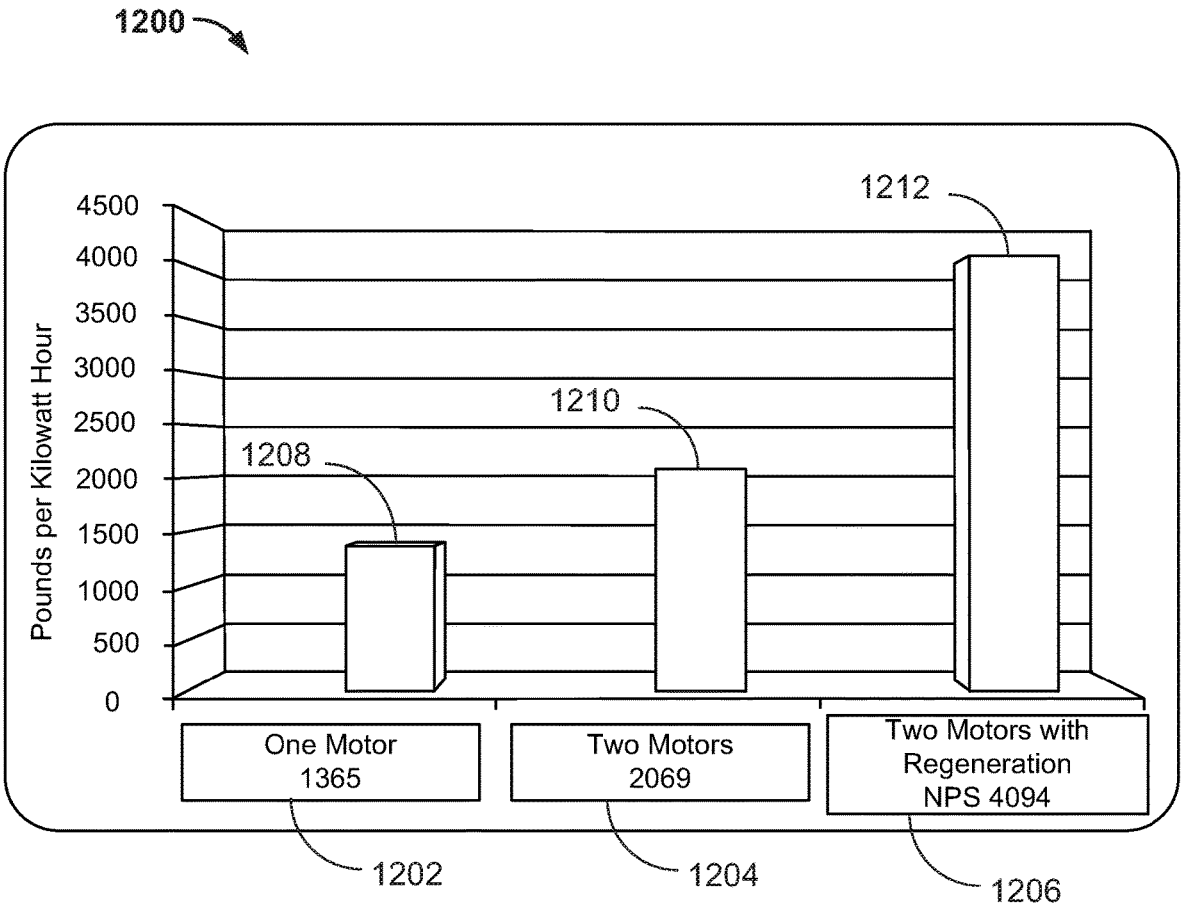
FIG. 12 is a graph illustrating a comparison of an amount of energy consumed by a known roll-forming system and roll-forming systems described herein.

FIG. 12 is a graph illustrating a comparison of an amount of energy consumed by a known production system 1202, a production system 1204 described herein having a split-drive system and a production system 1206 described herein having a split-drive system and a regeneration module (e.g., the leveler 102). Referring to FIG. 12, each example graph 1208, 1210 and 1212 represents an amount of Pounds Processed per Kilowatt Hour ("KWH") that was collected from the respective leveler apparatus 1202, 1204 and 1206. The pounds of steel processed per kilowatt hour may be determined by dividing the total weight of steel processed by the total kilowatt hours consumed as a result of processing (e.g., leveling) that steel. For example, a kilowatt hour meter was operatively coupled to each of the different leveler apparatus 1202, 1204 and 1206 to determine the kilowatt hours and the total amount of steel processed was weighed.

The first leveler apparatus 1202 is a conventional leveler apparatus having a single drive or motor and produced 1366 lbs/KWH. The second leveler apparatus 1204 is a split-drive leveler apparatus such as, for example, the split-drive leveler 102 of FIG. 1A without having a regeneration module such as the regeneration module 224 of FIG. 2. The second leveler apparatus 1204 produced approximately 2069 lbs/KWH, a savings of approximately 34% compared to the leveler 1202. The third leveler apparatus 1206 is a split-drive leveler apparatus such as, for example the split-drive leveler 102 of FIG. 1A having a regeneration module such as the regeneration module 224 of FIG. 2. Regenerated energy was captured and fed back to the system via a bus to be reused by both motors in the system. The third leveler apparatus produced 4094 lbs/KWH, a savings of approximately 333% compared to the leveler 1202. Further, although not shown, in a torque matching application, the efficiency and/or cost savings may be greater than that shown in the graph 1206.

FIG. 13 is a graph 1300 illustrating example energy costs for a conventional leveler having a single motor such as, for example, the leveler 1202 of FIG. 12.

FIG. 14 is a graph 1400 illustrating example energy costs for a split-drive leveler apparatus described herein having a regeneration module such as, for example the leveler 102 of FIGS. 1A, 1B and 2 and the leveler 1206 of FIG. 12.

Although certain methods and apparatus have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A strip material processing apparatus comprising:
a first workroll;
a first drive system to drive the first workroll;
a second workroll;
a second drive system to drive the second workroll; and
a controller programmed to:
provide a first command reference to the first drive system to drive the first workroll at a first speed,
determine a first torque value of the first drive system when the first drive system operates at the first command reference,
determine a second torque value of the second drive system,
compare a measured second speed of the second workroll to an acceptable speed range to determine whether to operate the second workroll in a first operating mode or a second operating mode;
upon verifying that the measured second speed of the second workroll is within the acceptable speed range, operate the second workroll in the first operating mode in which the second workroll is driven via the second drive system to maintain a first ratio of the first torque value to the second torque value such that the first torque value and the second torque value are different, and
upon verifying that the measured second speed of the second workroll is not within the acceptable speed range, operate the second workroll in the second operating mode in which a second command reference is provided from the controller to the second drive system to drive the second workroll based on a second ratio of the first speed to the second speed.

2. The strip material processing apparatus of claim 1, wherein the second ratio is equal to a range from approximately between 1.00 to 1.05.

3. The strip material processing apparatus of claim 1, wherein the second ratio is equal to a range from approximately between 0.95 to 1.00.

4. The strip material processing apparatus of claim 1, wherein the first workroll is an exit workroll at an exit of the strip material processing apparatus, and wherein the second workroll is an entry workroll at an entry of the strip material processing apparatus.

5. The strip material processing apparatus of claim 4, wherein the second torque value is less than the first torque value.

6. The strip material processing apparatus of claim 1, wherein the first workroll is an entry workroll at an entry of the strip material processing apparatus, and wherein the second workroll is an exit workroll at an exit of the strip material processing apparatus.

7. The strip material processing apparatus of claim 1, wherein the strip material processing apparatus includes a roll former.

8. The strip material processing apparatus of claim 1, further including a regeneration module electrically coupled to the first and second drive systems via the controller, the regeneration module to transfer regenerated electricity produced by a torque mismatch to a first motor of the first drive system or a second motor of the second drive system.

9. The strip material processing apparatus of claim 1, wherein the controller is programmed to determine the first torque value by measuring an output torque value or receiving an output torque value of the first drive system.

10. A method comprising:

controlling, via a processor, a first drive system to drive a first workroll;

measuring an output value of the first drive system;

controlling, via the processor, a second drive system to drive a second workroll based on the output value;

measuring a first speed of the second workroll;

determining, via the processor, whether the first speed is within an acceptable speed range to determine whether to operate the second workroll in a first operating mode or a second operating mode;

upon verifying that the first speed is not within the acceptable speed range, operating the second workroll in the first operating mode by controlling, via the processor, the second workroll at the first speed based on a ratio of the first speed to a second speed of the first workroll; and upon verifying that the first speed is within the acceptable speed range, operating the second workroll in the second operating mode by controlling, via the processor, the second workroll to maintain a ratio of a first torque value of the first workroll to a second torque value of the second workroll such that the first torque value and the second torque value are different.

11. The method of claim 10, wherein the ratio is equal to a range from approximately between 1.00 to 1.05.

12. The method of claim 10, wherein the ratio is equal to a range from approximately between 0.95 to 1.00.

13. The method of claim 10, wherein the first workroll includes an exit workroll and the second workroll includes an entry workroll.

14. The method of claim 13, wherein the second torque value of the second workroll is less than the first torque value of the first workroll.

15. The method of claim 10, wherein the first workroll includes an entry workroll and the second workroll includes an exit workroll.

16. The method of claim 10, further including regenerating, via a regeneration module, electricity produced by a torque mismatch between the second drive system to the first drive system.

* * * * *